US010480178B2

(12) United States Patent
Espinosa

(10) Patent No.: US 10,480,178 B2
(45) Date of Patent: Nov. 19, 2019

(54) REINFORCED BUILDING WALL

(71) Applicant: CETRES HOLDINGS, LLC, Jackson, WY (US)

(72) Inventor: Thomas M Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 0 days.

(21) Appl. No.: 15/843,992

(22) Filed: Dec. 15, 2017

(65) Prior Publication Data

US 2018/0202146 A1 Jul. 19, 2018

Related U.S. Application Data

(63) Continuation of application No. 14/891,449, filed as application No. PCT/US2014/038967 on May 21, 2014, now Pat. No. 9,874,009.
(Continued)

(51) Int. Cl.
*E04B 1/00* (2006.01)
*E04B 1/41* (2006.01)
(Continued)

(52) U.S. Cl.
CPC ..... *E04B 1/4157* (2013.01); *E04B 1/26* (2013.01); *E04B 2/56* (2013.01);
(Continued)

(58) Field of Classification Search
CPC ..... E04B 2001/268; E04B 2001/2684; E04B 2001/2692; E04B 2001/3583; E04C 3/292; E04H 9/14
(Continued)

(56) References Cited

U.S. PATENT DOCUMENTS 518,793 A * 4/1894 Smith ..... E04C 5/165 403/305
1,375,402 A 4/1921 McAvoy
(Continued)

OTHER PUBLICATIONS

WIPO, International Search Report and Written Opinion of the International Searching Authority, PCT/US2014/038967, dated Oct. 9, 2014.

*Primary Examiner* — Kyle J. Walraed-Sullivan
(74) *Attorney, Agent, or Firm* — Shlesinger, Arkwright & Garvey LLP

(57) ABSTRACT

A reinforced building wall comprises a foundation; an anchor rod extending from the foundation; a first stud wall disposed above the foundation, the first stud wall including a first bottom plate and a first top place; a second stud wall disposed above the first stud wall, the second stud wall including a second bottom plate and a second top plate; the first tie rod including first and second threaded end portions, the first end portion is operably connected to the anchor rod; a second tie rod including third and fourth threaded end portions, the third end portion is operably connected to the second end portion of the first tie rod; the second tie rod including an outer end portion operably attached to the second stud wall; an intermediate portion of the first tie rod is unthreaded and comprises at least about 75% of the length of the first tie rod; and an intermediate portion of the second tie rod is unthreaded and comprises at least about 75% of the length of the second tie rod.

16 Claims, 39 Drawing Sheets

Related U.S. Application Data

(60) Provisional application No. 61/826,839, filed on May 23, 2013.

(51) Int. Cl.
*E04B 1/26* (2006.01)
*E04B 2/56* (2006.01)
*E04B 1/35* (2006.01)

(52) U.S. Cl.
CPC ..... *E04B 2001/2684* (2013.01); *E04B 2001/2688* (2013.01); *E04B 2001/3583* (2013.01)

(58) Field of Classification Search
USPC ..... 52/23, 223.13, 236.6, 293.3, 295, 410, 52/745.12
See application file for complete search history.

(56) References Cited

U.S. PATENT DOCUMENTS 3,369,334 A * 2/1968 Berg ..... E04B 1/06 52/223.13
3,415,552 A * 12/1968 Howlett ..... E04C 5/165 403/305
3,756,635 A * 9/1973 Beers ..... F16B 11/008 312/111
4,452,028 A * 6/1984 Norton ..... E02D 37/00 52/295
4,457,118 A 7/1984 Bowen
4,525,972 A 7/1985 Palacio et al.
4,812,096 A * 3/1989 Peterson ..... F16B 31/04 29/446
4,875,314 A 10/1989 Boilen
5,168,681 A * 12/1992 Ayrapetyan ..... E04B 5/12 52/223.7
5,303,520 A 4/1994 Gozdziaak
5,384,993 A * 1/1995 Phillips ..... E04B 1/34347 52/223.6
5,411,347 A * 5/1995 Bowmer ..... E04C 5/165 403/305
5,448,861 A * 9/1995 Lawson ..... E04H 9/14 52/92.2
5,491,935 A * 2/1996 Coxum ..... E04B 7/02 52/92.2
5,531,054 A * 7/1996 Ramirez ..... E04H 9/14 52/741.1
5,535,561 A * 7/1996 Schuyler ..... E04B 1/0007 52/223.13
5,537,786 A 7/1996 Lozier et al.
5,570,549 A * 11/1996 Lung ..... E04C 5/125 52/295
5,673,883 A * 10/1997 Figueroa, Jr. ..... E04G 21/28 248/200.1
5,740,643 A * 4/1998 Huntley ..... E04B 1/94 52/265
5,746,555 A * 5/1998 McEvoy ..... E04C 5/165 403/307
5,761,863 A 6/1998 Sutt, Jr. et al.
6,073,642 A * 6/2000 Huang ..... A45B 9/00 135/114
6,161,350 A * 12/2000 Espinosa ..... E04H 9/02 52/293.3
6,367,205 B2 4/2002 Cornett, Sr.
6,390,747 B1 5/2002 Commins
6,553,736 B2 4/2003 Montanaro et al.
7,621,085 B2 11/2009 Commins
7,762,030 B2 * 7/2010 Espinosa ..... E02D 27/34 52/293.3
7,878,730 B2 * 2/2011 Weaver ..... E04O 5/161 403/293
7,985,041 B2 * 7/2011 Lin ..... F16B 37/00 411/388
8,136,318 B2 3/2012 Espinosa
8,434,281 B2 * 5/2013 Halfon ..... E06B 3/4636 49/396
9,097,000 B2 8/2015 Espinosa
9,303,399 B2 * 4/2016 Espinosa ..... E04B 1/4114
D813,023 S * 3/2018 Reigstad ..... D8/382
2001/0037611 A1 * 11/2001 Cornett, Sr. ..... E04B 7/02 52/23
2002/0020137 A1 * 2/2002 Commins ..... E04B 1/2604 52/712
2002/0100226 A1 * 8/2002 Huppert ..... E04B 1/2604 52/23
2003/0136075 A1 7/2003 Brackett
2003/0182875 A1 * 10/2003 Hill ..... E04B 7/00 52/92.1
2003/0230032 A1 * 12/2003 Shahnazarian ..... E04H 9/14 52/167.3
2004/0118053 A1 * 6/2004 Huppert ..... E04B 1/2604 52/23
2005/0050843 A1 * 3/2005 Colarusso ..... B21O 5/00 52/749.1
2005/0055897 A1 * 3/2005 Commins ..... E04B 1/26 52/169.1
2005/0100428 A1 * 5/2005 Commins ..... F16B 5/0233 411/536
2005/0193681 A1 * 9/2005 Brackett ..... E04H 9/028 52/698
2006/0133912 A1 * 6/2006 Commins ..... E04B 1/2604 411/536
2006/0156657 A1 * 7/2006 Commins ..... E04B 1/2604 52/223.13
2007/0175167 A1 * 8/2007 Allen ..... E04C 5/165 403/307
2008/0245004 A1 * 10/2008 Pryor ..... E04B 1/26 52/223.4
2009/0307988 A1 12/2009 Hamlinn, III
2010/0031607 A1 * 2/2010 Oliva ..... E04C 5/165 52/848
2010/0180540 A1 7/2010 Shepard
2011/0041449 A1 * 2/2011 Espinosa ..... E02D 35/00 52/698
2011/0072732 A1 * 3/2011 Schilling ..... E04H 9/14 52/23
2011/0192111 A1 * 8/2011 White ..... E04B 1/4121 52/699
2012/0240495 A1 * 9/2012 Eychaner ..... E04B 9/127 52/220.6
2012/0304589 A1 * 12/2012 Commins ..... E04B 1/2604 52/745.21
2014/0010590 A1 * 1/2014 Stewart ..... C21D 9/0075 403/345
2014/0130449 A1 * 5/2014 Chadwick ..... E04B 2/702 52/843
2015/0204092 A1 * 7/2015 Crumley ..... E04G 23/0229 52/514
2017/0097090 A1 * 4/2017 Lochmann ..... F02F 3/00

* cited by examiner

REINFORCED BUILDING WALL

FIELD OF THE INVENTION

The present invention is generally directed to reinforced frame construction walls employing ties rods for connecting the walls to the foundation.

SUMMARY OF THE INVENTION

The present invention provides a reinforced building wall comprising a foundation; an anchor rod extending from the foundation; a first stud wall disposed above the foundation, the first stud wall including a first bottom plate and a first top place; a second stud wall disposed above the first stud wall, the second stud wall including a second bottom plate and a second top plate; the first tie rod including first and second threaded end portions, the first end portion is operably connected to the anchor rod; a second tie rod including third and fourth threaded end portions, the third end portion is operably connected to the second end portion of the first tie rod; the second tie rod including an outer end portion operably attached to the second stud wall; an intermediate portion of the first tie rod is unthreaded and comprises at least about 75% of the length of the first tie rod; and an intermediate portion of the second tie rod is unthreaded and comprises at least about 75% of the length of the second tie rod.

DETAILED DESCRIPTION OF THE INVENTION

Figure 1:
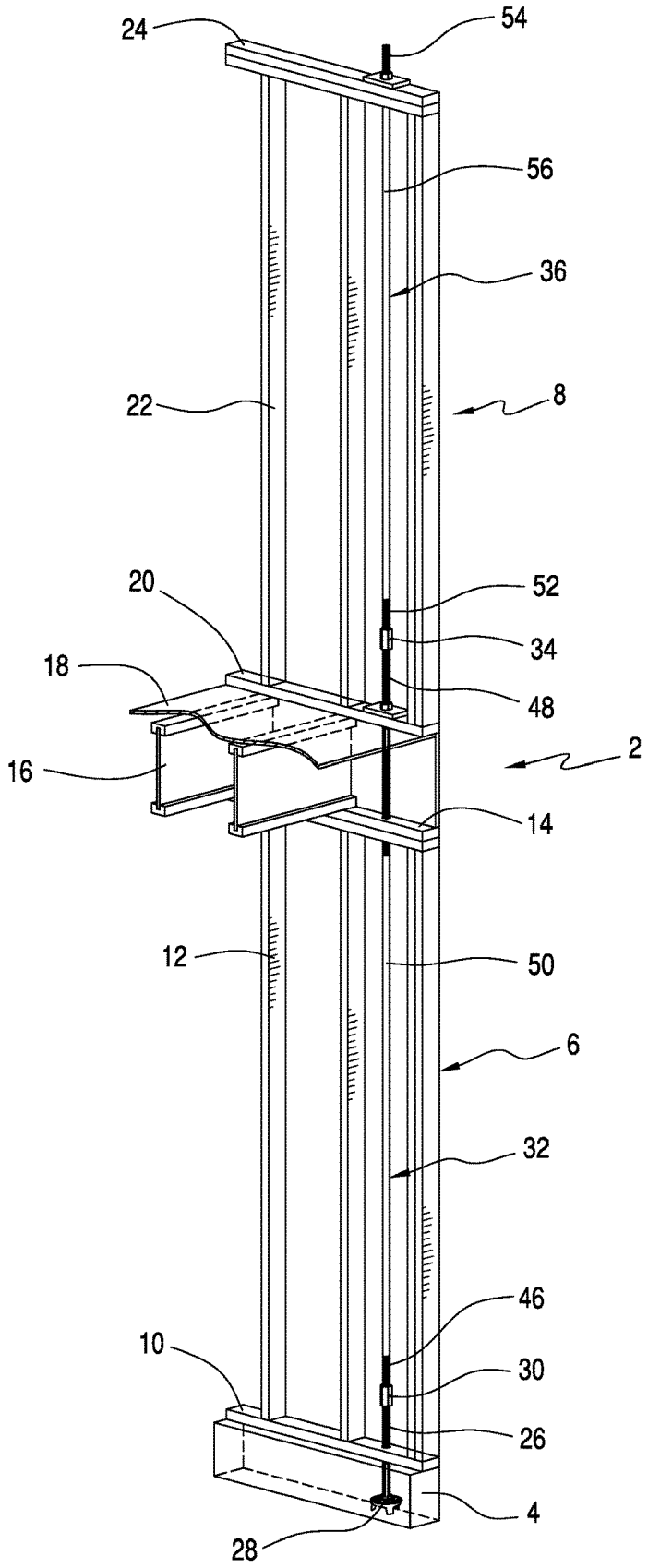
FIG. 1 is a perspective fragmentary view of a building stud wall, showing a tie rod connected to the wall and the foundation.

Referring to FIG. 1, a reinforced frame construction building wall 2 is disclosed. The building wall 2 is disposed above a foundation 4, and includes a lower stud wall 6 and an upper stud wall 8 disposed above the lower stud wall 6. The framing members of the stud walls disclosed herein may be made of wood or metal or other suitable materials.

The lower stud wall 6 has a bottom plate 10 supported by the foundation 4, a plurality of studs 12 and a double top plate 14. A plurality of floor joists 16 are supported by the top plate 14. A sub-floor 18 is supported by the floor joists 16. The upper stud wall 8 includes a bottom plate 20, a plurality of studs 22 and a double top plate 24.

The foundation 4 may be made of poured concrete or other suitable materials. The foundation refers generally to any structure that is used to anchor or tie a wall or building to the ground. Examples are post tension deck (PTD), slab on grade (SOG), slab drilled and epoxy studs inserted (Epoxy), coupler welded to beam (Steelbeam), drilled and secured from the bottom of the woodbeam (Woodbeam) foundation walls, and any substantial structure solidly anchored in the ground. Accordingly, a foundation can be any structure that is capable of transferring the load of the wall or building to the ground.

An anchor rod 26 is attached to an anchor assembly 28, which is operably attached to the foundation 4, such as being embedded within the foundation 4 made of poured concrete. The anchor rod 26 extends outside the foundation 4 and through the base plate 10. A coupling 30 connects the anchor rod 26 to a lower tie rod 32, which extends through the top plate 14 and the bottom plate 20. Another coupling 34 connects the tie rod 32 to an upper tie rod 36, which extends through the top plate 24. The coupling 34 is disposed in the stud wall 8 above the bottom plate 20.

Figure 2:
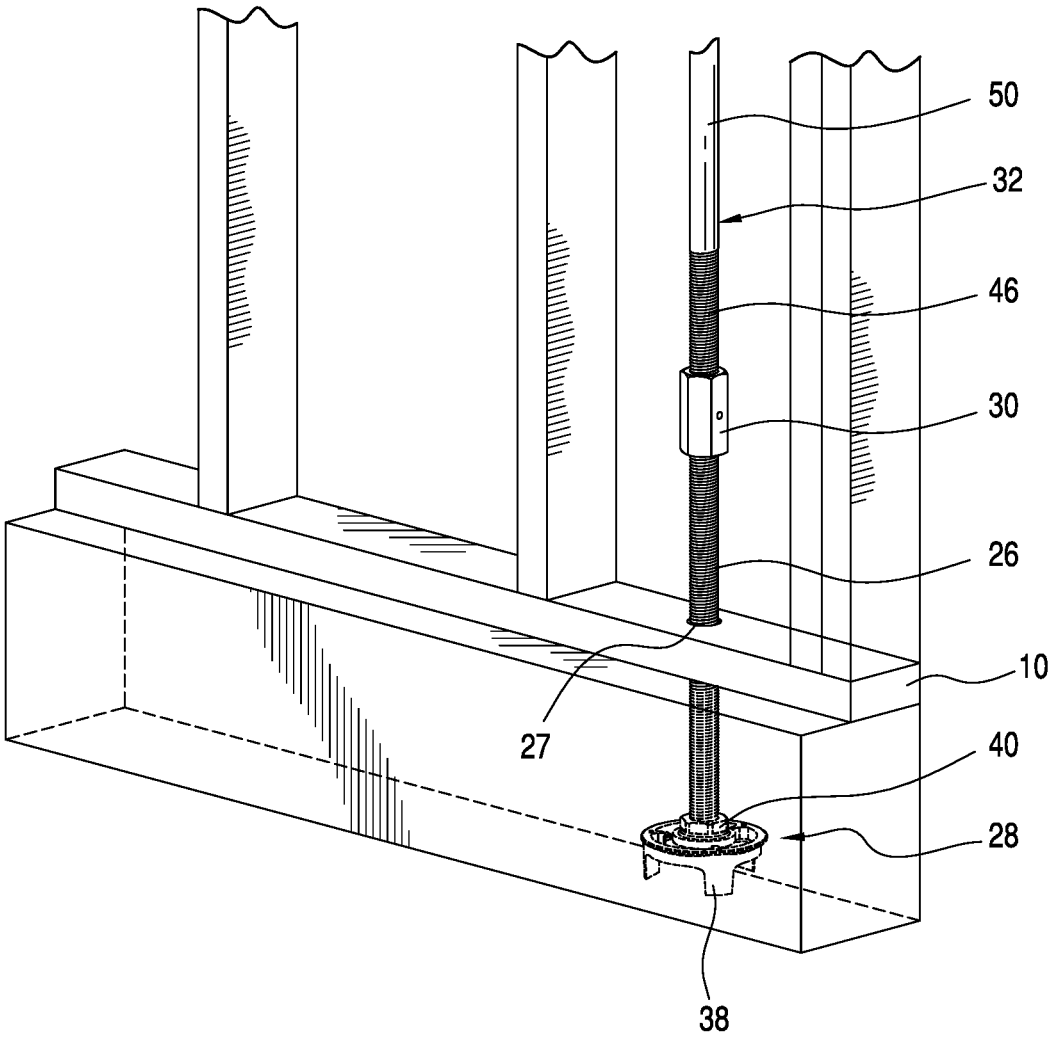
FIG. 2 is an enlarged perspective view of the anchor rod and anchor assembly shown in FIG. 1.

Referring to FIG. 2, the anchor assembly 28 includes an anchor rod support 38 and an anchor body 40 threaded to the anchor rod 26. The anchor rod 26 extends through an opening 27 in the bottom plate 10. The anchor assembly 28 is similar to that disclosed in co-pending application Ser. Nos. 12/656,623 and 12/656,624, incorporated herein by reference. Other anchor assemblies of standard design may be used. The anchor rod 26 is disclosed as being all-thread, but it should understood that a smooth rod with only its end portions being threaded for screwing to the anchor body 40 and the coupling 30 may also be used.

Figure 3:
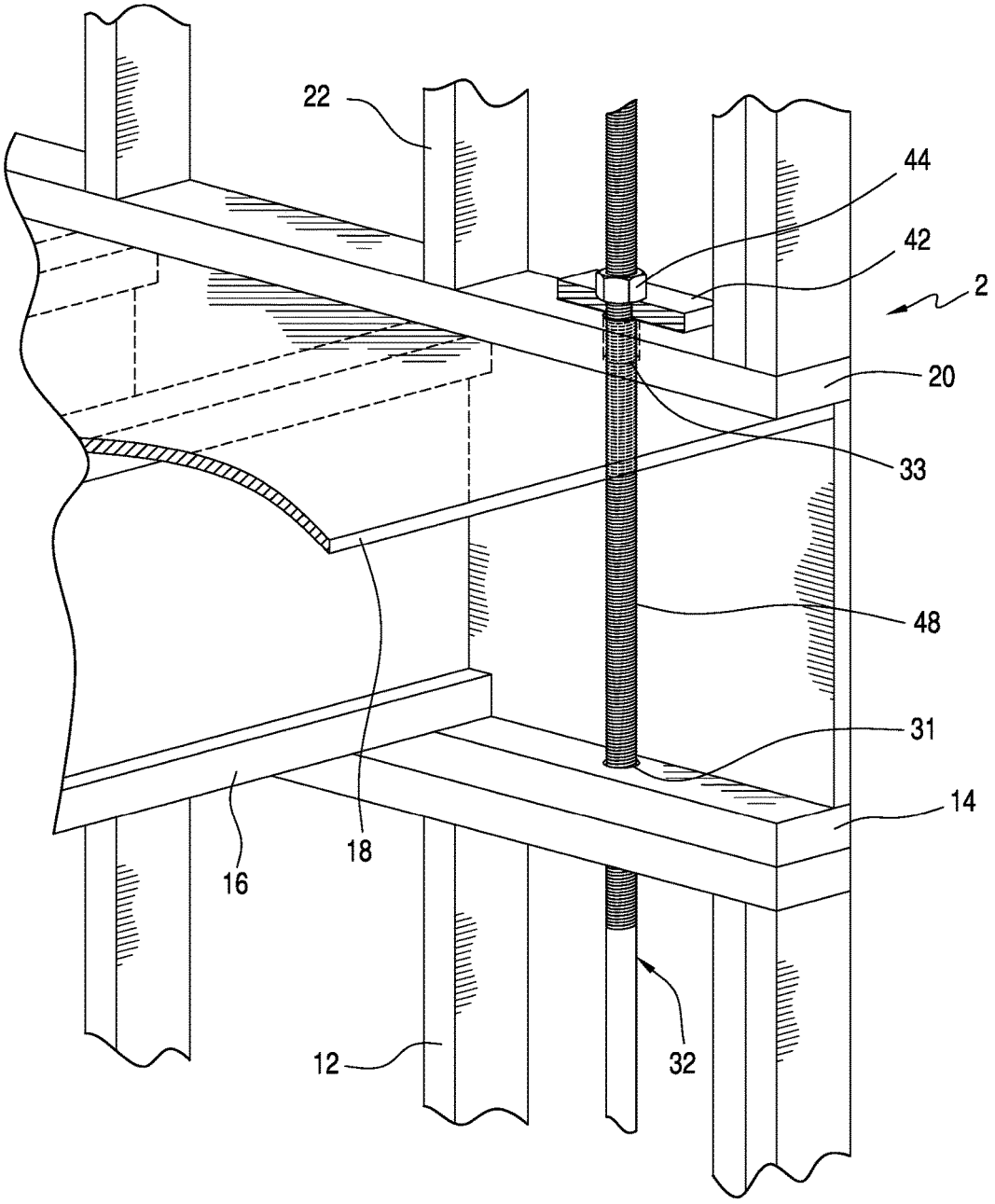
FIG. 3 is an enlarged perspective view of a portion of the tie rod through the floor joist section of the wall shown in FIG. 1, showing a connection of the tie rod to the bottom plate of the upper wall.

Referring to FIG. 3, the tie rod 32 is operably attached to the wall 2 with a bearing plate 42 (shown in cross-section) and a nut 44 threaded to the end portion 48. The nut 44 is tightened against the bearing plate 42 to advantageously place the anchor rod 32 under tension. The upper end portion 48 extends through the double top plate 14 into the floor joist space and the through the bottom plate 20 through openings 31 and 33, respectively.

Referring back to FIG. 1, the lower end portion 46 and the upper end portion 48 of the tie rod 32 are threaded while the rest or intermediate portion 50 of the tie rod is smooth and unthreaded. The combined length of the threaded end portions 56 and 48 is about 25% or less of the length of the tie rod 32. The upper tie rod 36 also has a lower threaded end portion 52, an upper threaded portion 54 and a smooth unthreaded intermediate portion 56. The combined length of the threaded end portions 52 and 54 is about 25% or less of the length of the tie rod 36. The smooth portions 50 and 56 are preferably at least about 75% of the length of the respective tie rod. The 75% ratio means that at least a majority portion of the tie rod within the stud wall space where insulation, wiring, plumbing, etc. would be installed is smooth and unthreaded, thereby making for relatively easy installation of insulation, wiring, plumbing, etc. as compared to an all-thread tie rod. An all-thread tie rod provides sharp edges of the threads to building components that would hamper the installation of these components in the wall space and cause the tie rod to bow. If the threads of an all-thread tie rod were caught in the other building components during installation and became bowed, the tie rod would not return to its original straight position.

Figure 4:
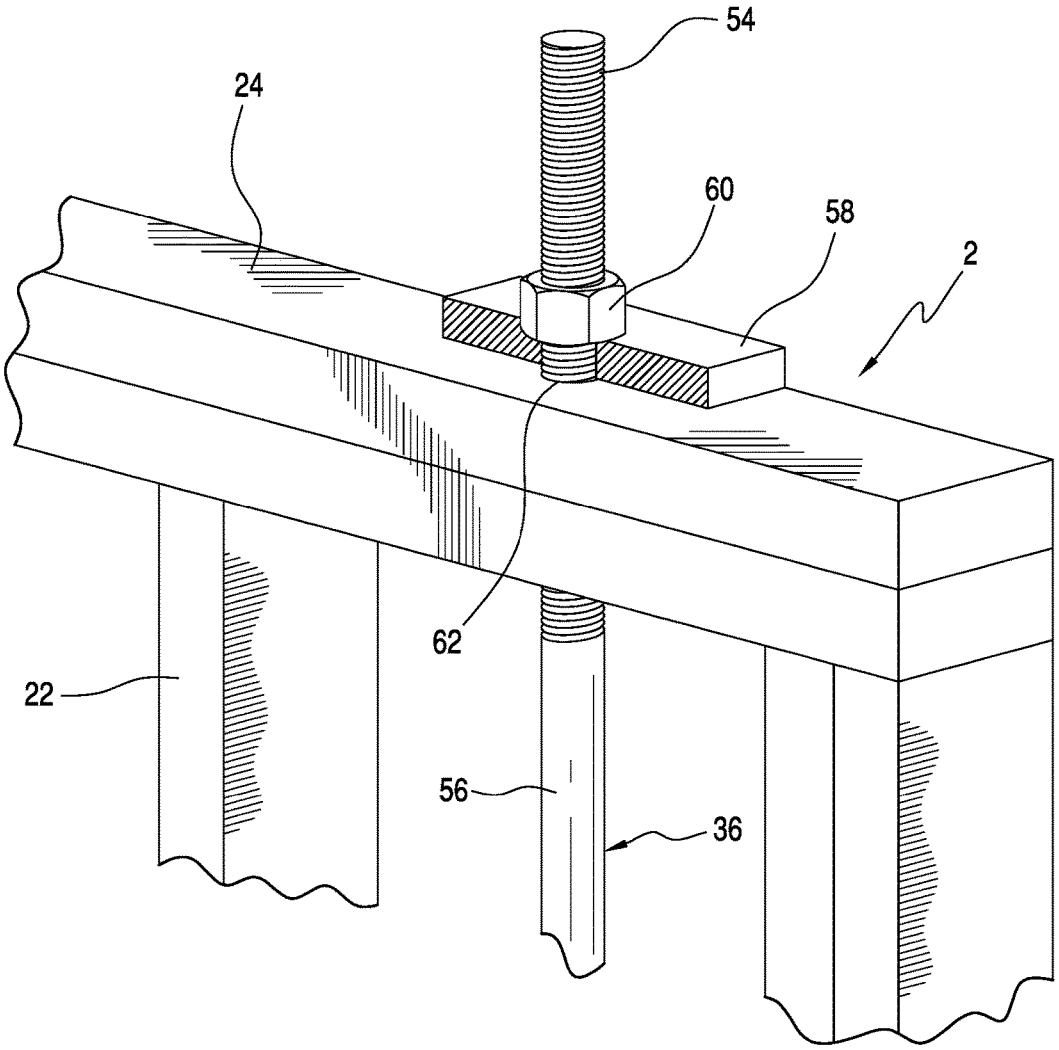
FIG. 4 is an enlarged perspective view of a section of the wall shown in FIG. 1, showing the connection of the tie rod at the top plate of the upper wall.

Referring to FIG. 4, the upper tie rod 36 is attached to the building wall 2 to with a bearing plate 58 (shown in cross-section) and a nut 60 threaded to the upper end portion 54. The nut 60 is tightened against the bearing plate 58 to advantageously place the tie rod 36 under tension. The threaded upper end portion 54 extends through the double plate 24 through an opening 62. Anchoring the upper wall 8 to the top plate 24 advantageously ties the top plate 24 directly to the foundation 4, affording the top plate and any structure attached to it, such as roof trusses, relatively more strength against uplifting forces caused by storms, winds, tornadoes, etc.

Figure 5:
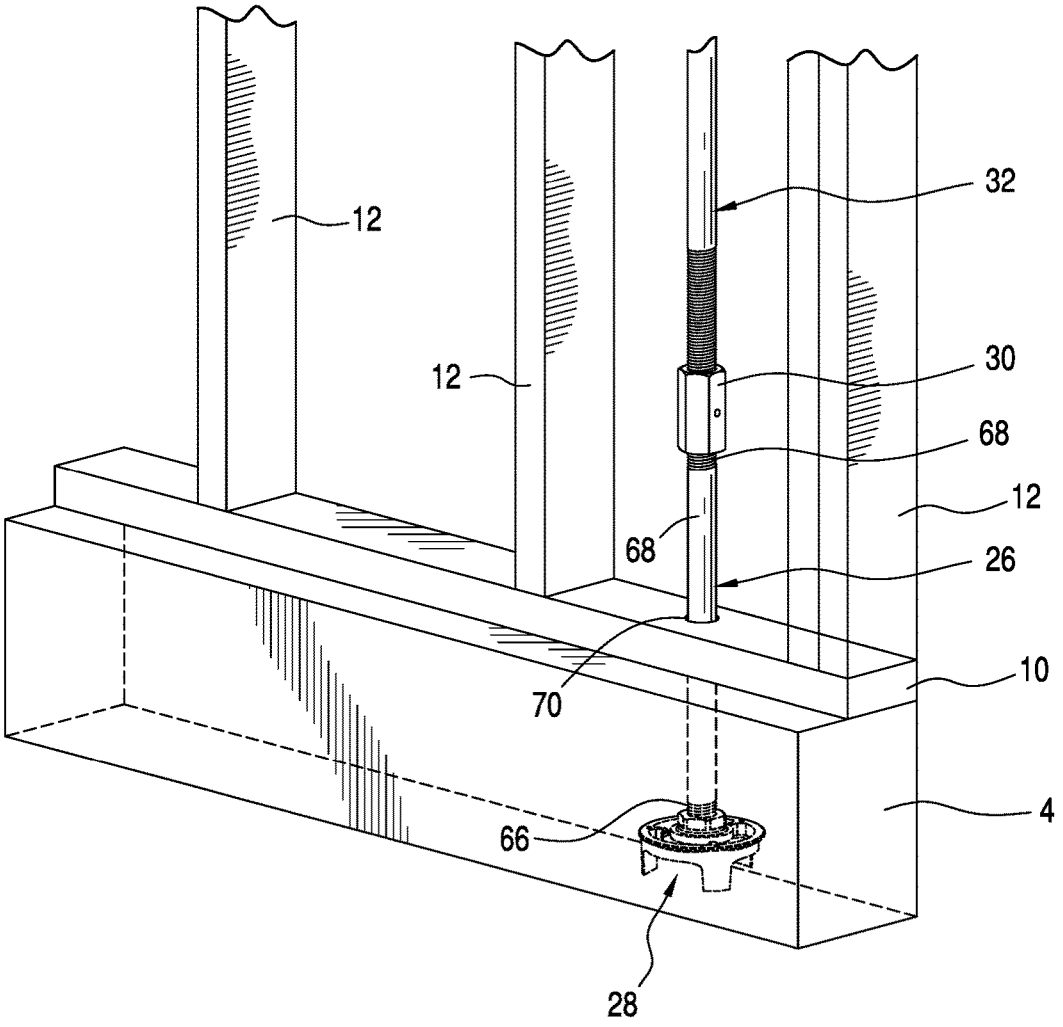
FIG. 5 is an enlarged perspective view of the anchor rod and anchor assembly shown in FIG. 1, showing another embodiment of the anchor rod.

Referring to FIG. 5, an anchor rod 64 has a lower threaded portion 66, a threaded upper portion 68 and a smooth and unthreaded intermediate portion 68. The intermediate smooth portion 68 comprises about 75% or more of the length of the rod. An opening 70 is provided in the bottom plate 10 for the rod 64 to extend through. The use of the anchor rod 64, with 75% or more being smooth and unthreaded, provides for providing a generally smooth and unthreaded tie rod within the stud wall space to facilitate the installation of insulation batts, electrical wiring, plumbing pipes, etc. within the wall.

Figure 6:
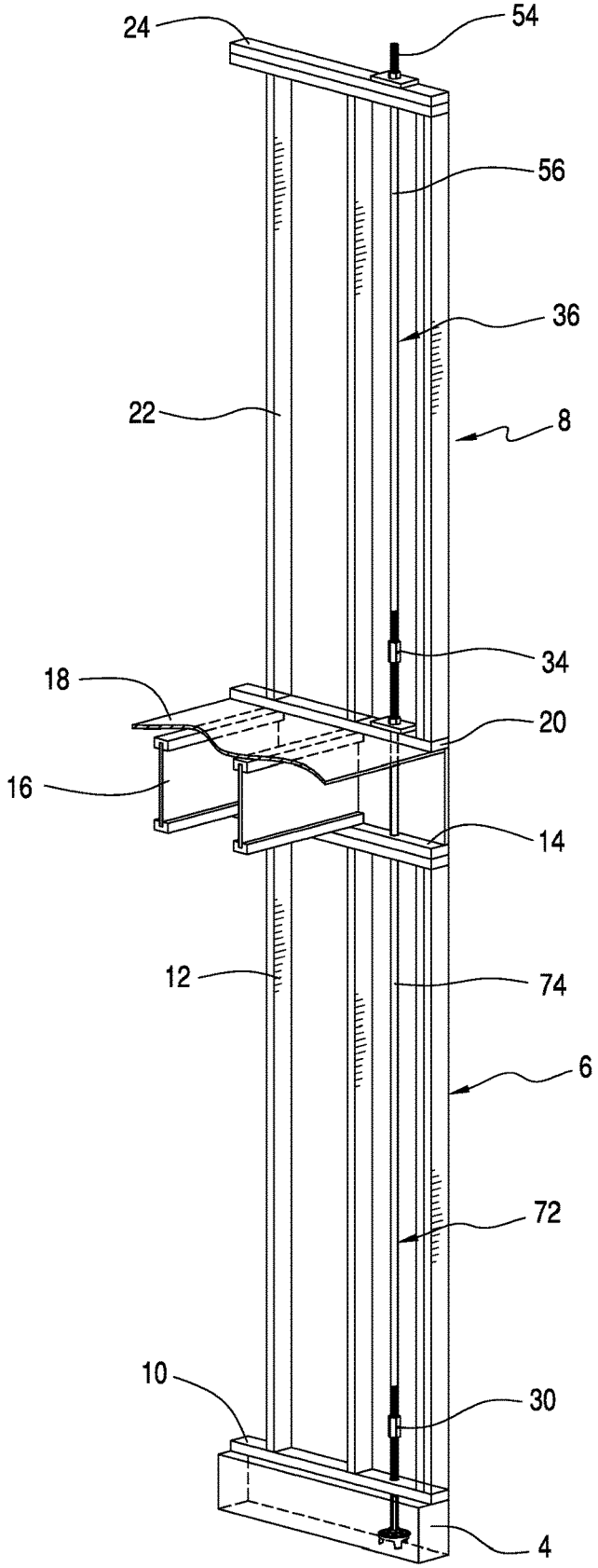
FIG. 6 is a perspective fragmentary view of a building stud wall similar to FIG. 1, showing another embodiment of the tie rod.

Referring to FIG. 6, a lower tie rod 72 is disclosed as being longer than the lower tie rod 32 shown in FIG. 1. The tie rod 72 has a longer smooth unthreaded intermediate portion 74 that extends through the floor joists space between the double top plate 14 and the bottom plate 20. The smooth and unthreaded portion 74 makes up at least about 75% of the length of the tie rod. The combined length of the threaded end portions of the tie rod 72 is about 25% or less of the length of the tie rod.

Figure 7:
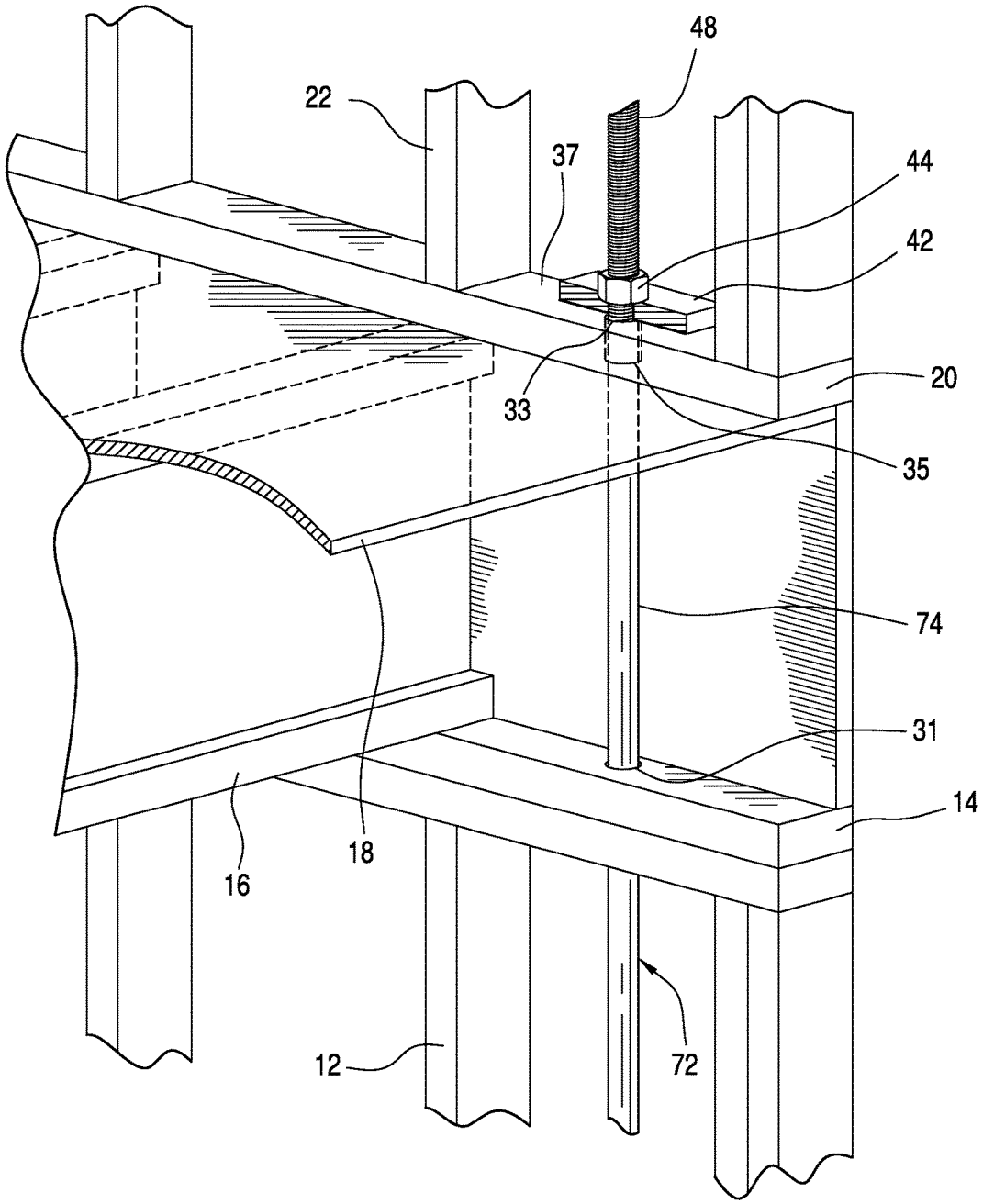
FIG. 7 is an enlarged perspective view of a portion of the tie rod through the floor joist section of the wall shown in FIG. 6, showing details of the tie rod within the floor joist section of the wall and connection to the bottom plate of the upper wall.

Referring to FIG. 7, it is shown that the smooth unthreaded intermediate portion 74 extends through the opening 31 and the opening 33. A portion 35 of the smooth unthreaded intermediate portion 74 abutting the threaded end portion 48 extends substantially through the entire depth of the opening 33. The portion 35 may extend above the top surface 37 of the bottom plate 20 into part of the thickness of the bearing plate 42. The smooth unthreaded portion 74 that goes through the openings 31 and 33 advantageously facilitates the threading of the tie rod 72 through the openings 31 and 33 due to reduced friction as compared to an all-threaded tie rod. Further, the smooth unthreaded portion 74 facilitates relative movement of the tie rod with respect to the double top plate 14 and the bottom plate 20 due to lesser friction with the wood when the walls 2 shifts due to settling, uplift, etc. and facilitates taking up any slack from the tie rod 72 when an expanding connector, such as a spring disposed between the nut 44 and the bearing plate 42, is used, as will be explained below. The openings 33 and 31 are larger than the diameter of the intermediate unthreaded portion 74, since the threaded end portions of the tie rod are larger in diameter than the intermediate unthreaded portion (see FIG. 33).

Contact of the jagged threaded end portion 48 with the wall of the openings 31 and 33 is avoided to reduce friction. Reduced friction causes the tie rod to remain straight and not bowed. The smooth unthreaded portion 74 also reduces friction especially when the openings 31 and 33 do not align up perfectly. Binding of the tie rod against the openings 31 and 33 is not desirable since it may cause bowing of the tie rod during wall movement rather than presenting a slack to an expanding connector when used. It should be understood that if the portion of the tie rod disposed within the openings 31 and 33 were threaded, then it is clear that sharp edges of the threads can easily bind and get stuck against the wall of the openings, causing bowing of the tie rod which will then prevent the presentation of a slack for the expanding connector to absorb.

Figure 8:
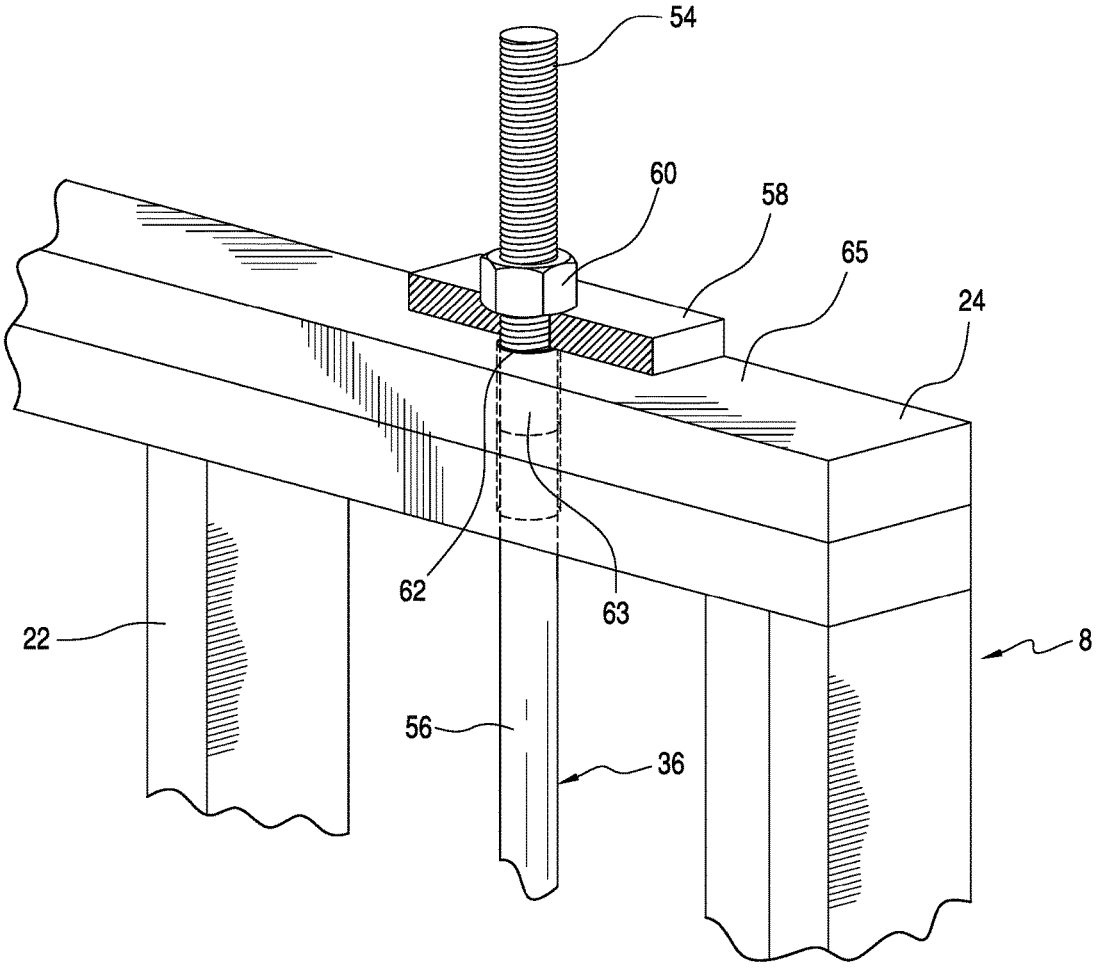
FIG. 8 is an enlarged perspective view of a section of the wall shown in FIG. 6, showing the connection of the tie rod at the top plate of the upper wall.

Referring to FIG. 8, the smooth unthreaded intermediate portion 56 of the upper tie rod 36 may extend through the opening 62 in the double top plate 24. A portion 63 of the smooth unthreaded intermediate portion 56 abutting the threaded end portion 54 extends substantially through the entire depth of the opening 62. The portion 63 may extend above the top surface 65 of the double top plate 24 into part of the thickness of the bearing plate 58 (shown in cross-section). Minimizing the amount of thread within the opening 62 means that the tie rod will have reduced friction against the wall of the opening 62 and can thereby move upwardly relatively easily when the upper wall 8 settles down. When an expanding connector, as will be explained below, is disposed between the nut 60 and the bearing plate 58 to take up any slack that develops, the ability of the tie rod 56 to move past the opening 62 ensures that the slack will be absorbed by the expanding connector. An expanding connector may be a spring urging the nut 60 upwardly and the bearing plate 58 downwardly.

Figure 9:
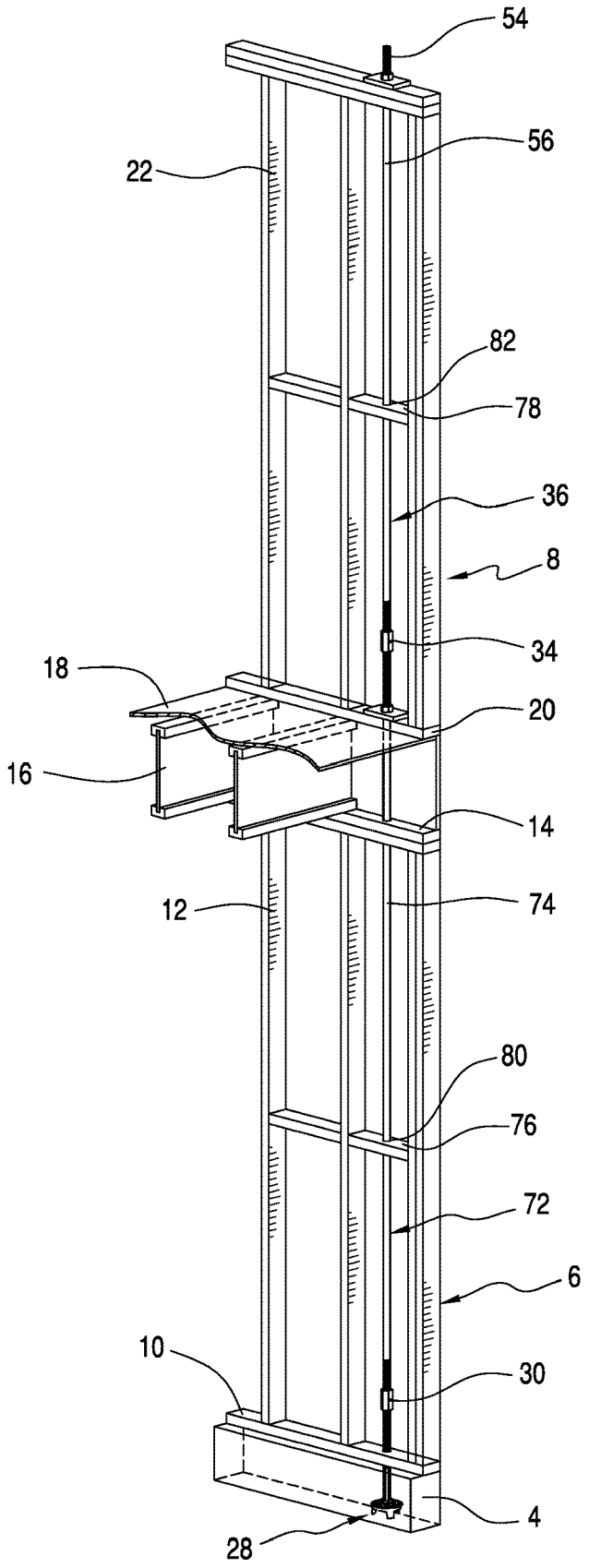
FIG. 9 is a perspective fragmentary view of a building stud wall similar to FIG. 6, showing reinforcement blockings within the wall.
Figure 10:
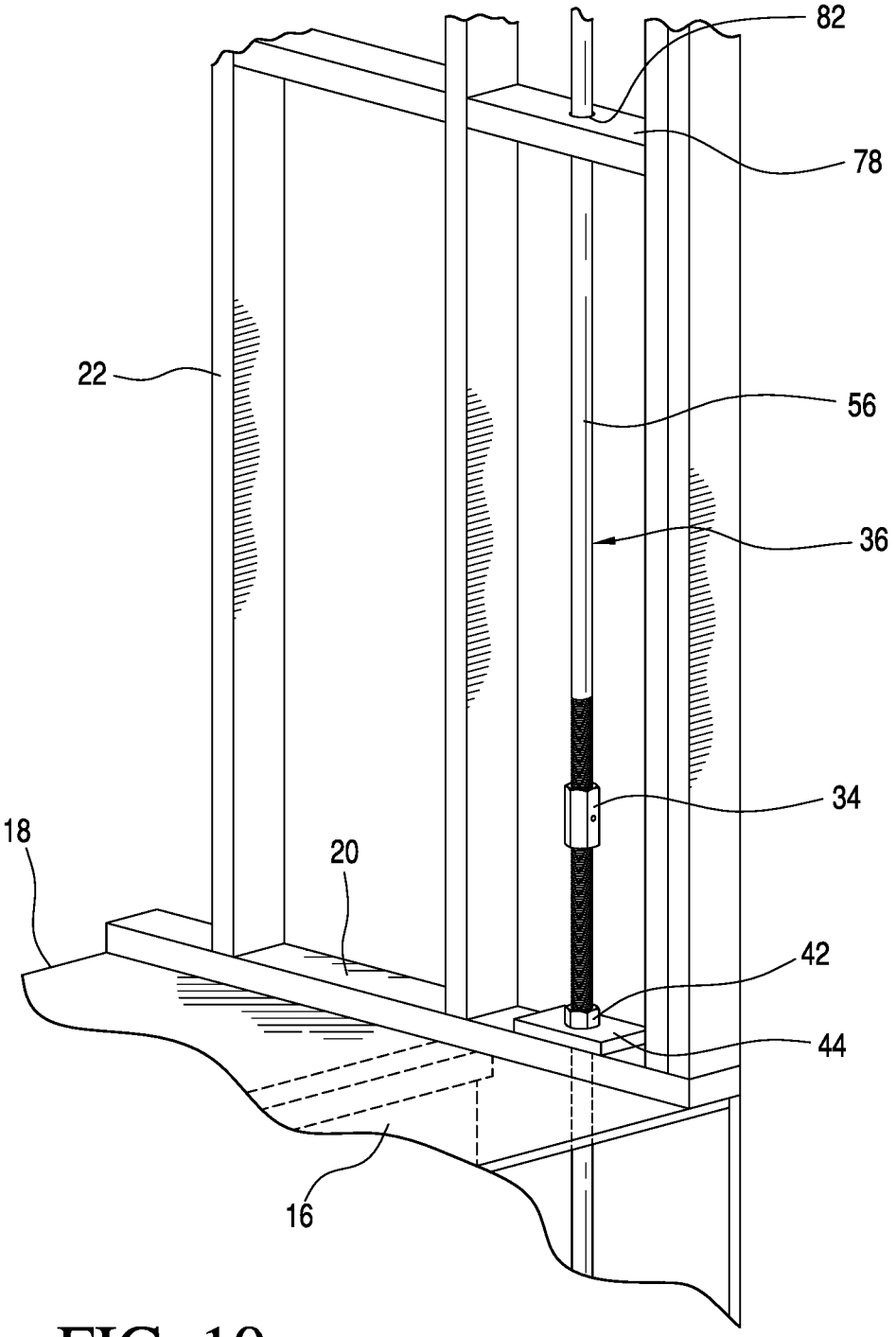
FIG. 10 is an enlarged perspective view of a section of the building wall shown in FIG. 9.

Referring to FIGS. 9 and 10, reinforcement blockings 76 and 78 are added to the respective stud walls 6 and 8 shown in FIG. 6. Reinforcement blockings are used to provide rigidity and additional nailing surfaces. The blockings 76 and 78 include respective openings 80 and 82 through which the smooth unthreaded intermediate portions 74 and 56 of the tie rods 72 and 36, respectively, pass through. Referring to FIG. 10, the blocking 78 is shown in greater detail. The addition of the blockings 76 and 78 add more difficulty to installing the tie rods 72 and 36, since the openings 80 and 82 are made in the field and may be off from the vertical and may not line up along a common axis with the openings 31, 33 and 62. With the use of the tie rods 72 and 36 with their smooth unthreaded intermediate portions, the installation of the tie rods 72 and 36 is thereby facilitated due to reduced friction afforded by the smooth unthreaded intermediate portions of the tie rods as compared to all-thread tie rods. Further, when slack expanding connectors are used with the nuts 44 and 60, movement of the tie rods through the respective openings 31, 33 and 62 when slack develops in the tie rods is relatively unhindered. Still further, the openings 80 and 82 have larger diameter than the intermediate portions 74 and 36 since the diameter of the threaded end portions of the tie rods are larger than the diameter of the intermediate unthreaded portion (see FIG. 33).

Figure 11:
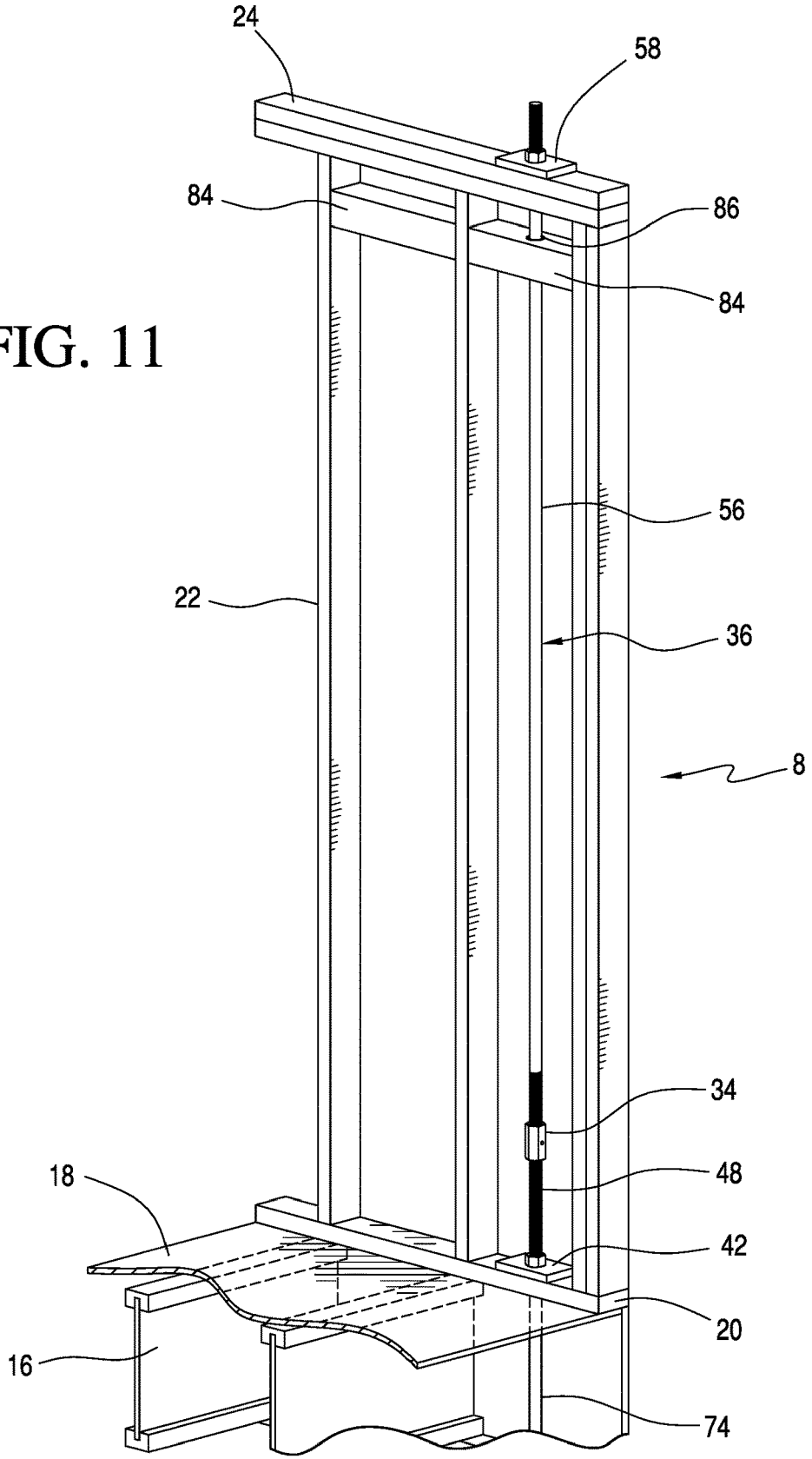
FIG. 11 is a perspective fragmentary view of the upper wall shown in FIG. 6, showing blockings near the top plate.
Figure 12:
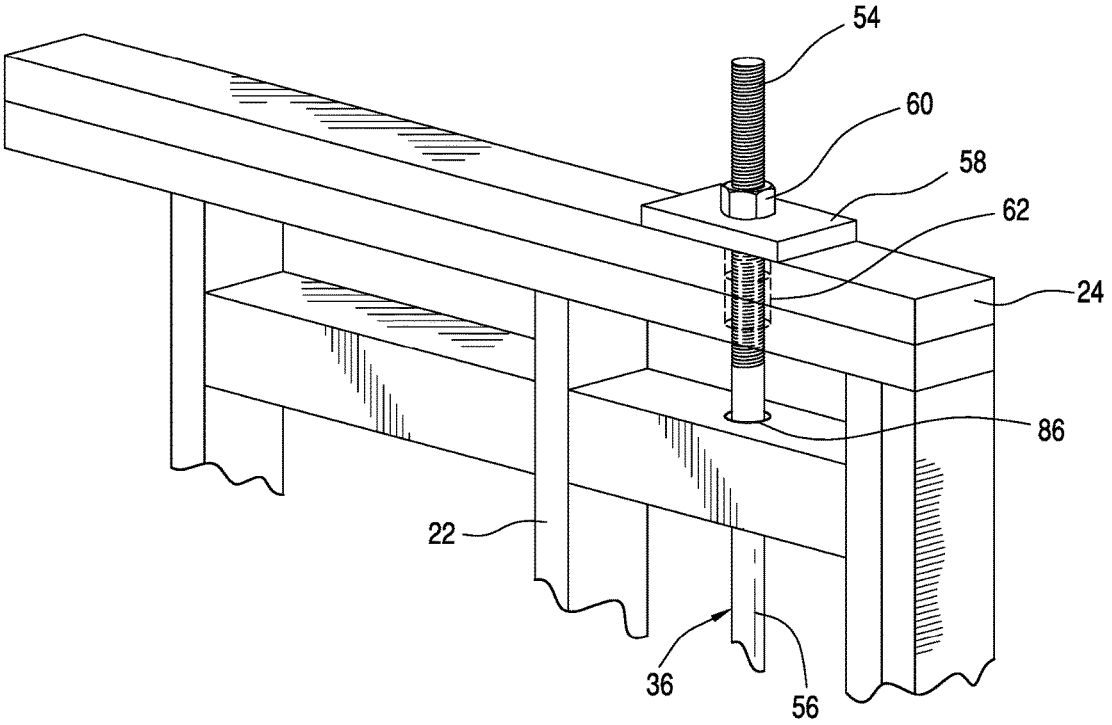
FIG. 12 is an enlarged perspective view of a section of the wall shown in FIG. 11.

Referring to FIGS. 11 and 12, the upper stud wall 8 is provided with heavier blocking 84, measuring for example 4 in. by 4 in, to provide additional rigidity to the upper portion of the stud wall. The intermediate portion 56 of the tie rod 36 extends through an opening 86 in the blocking 84. The smooth unthreaded intermediate portion 56 advantageously allows relatively easy installation of the tie rod 36, allowing the tie rod 36 to pass through the opening 86, even though the length of the opening 86 is longer that an opening through a standard stud, which is nominally 2 in. thick. The diameter of the opening 86 is larger than the diameter of the intermediate portion 56, since the diameter of the threaded end portion of the tie rod is larger than the diameter of the intermediate portion (see FIG. 33). Note that the opening 62 may be made larger than the outer diameter of the threaded end portion to allow relatively easy passing of the tie rod through the opening 62.

Figure 13:
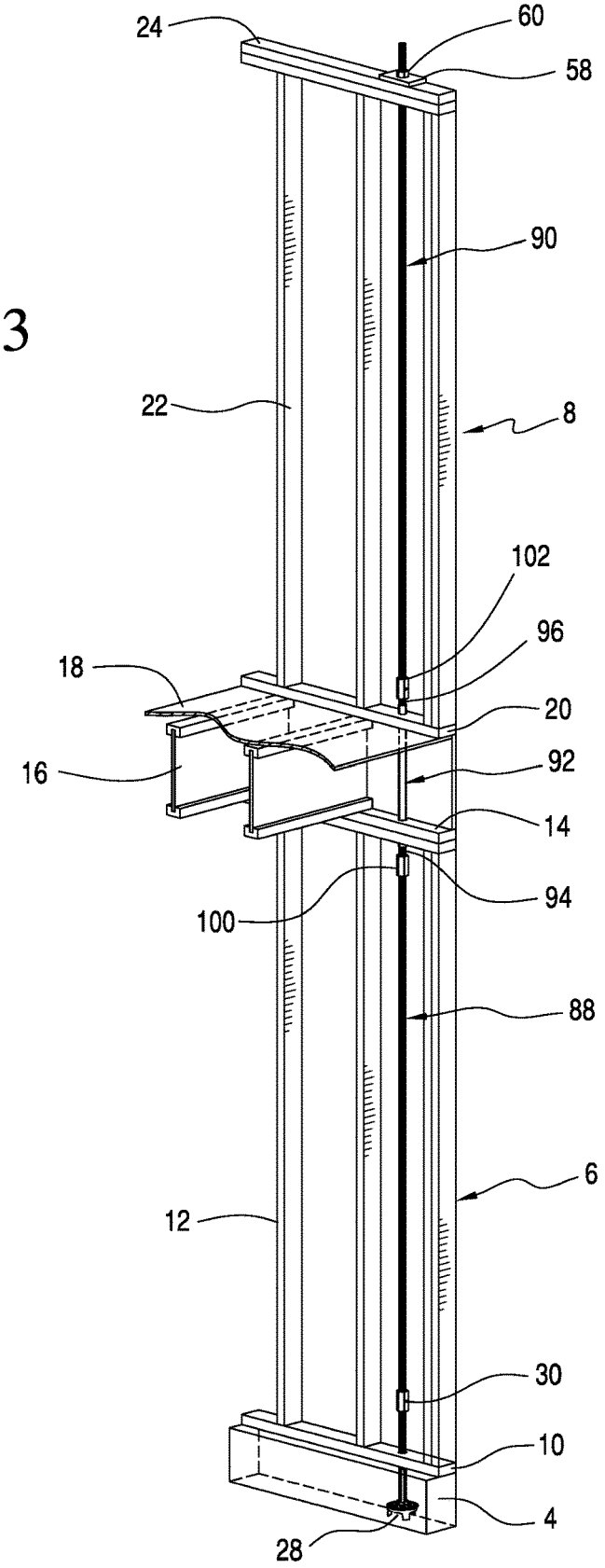
FIG. 13 is a perspective fragmentary view of a building stud wall similar to FIG. 1, showing another embodiment of the tie rod.
Figure 14:
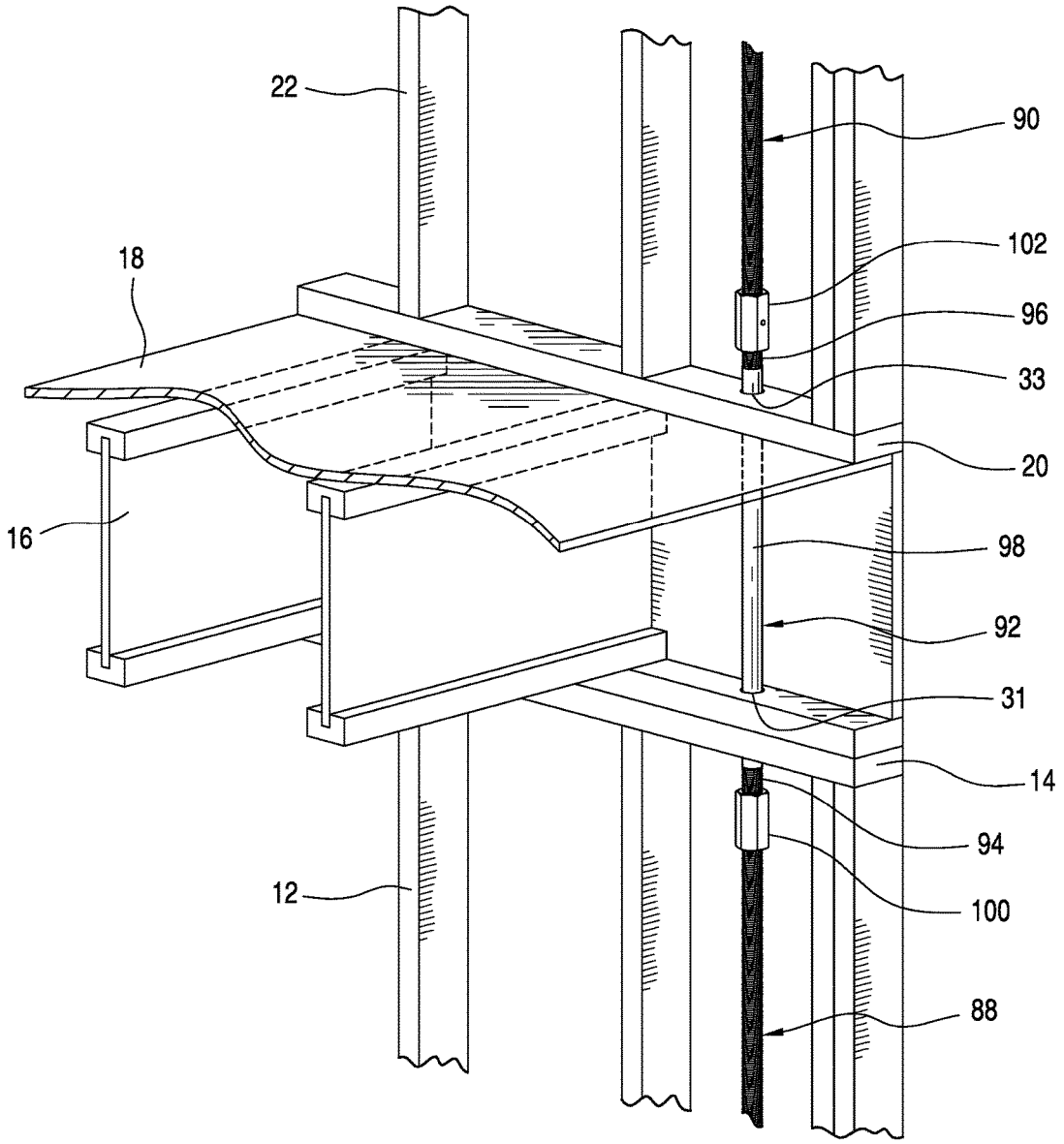
FIG. 14 is an enlarged perspective view of a portion of the tie rod through the floor joist section of the wall shown in FIG. 13, showing details of the tie rod within the floor joist section of the wall.

Referring to FIGS. 13 and 14, the same stud walls 6 and 8 are shown. A shorter tie rod 88 is shown associated with the lower stud wall 6. The tie rod 88 is disclosed as all-thread. Another tie rod 90, also all-thread, is associated with the stud wall 8. A short tie rod 92 is used to connect the lower tie rod 88 with the upper tie rod 90. The tie rod 92 has a lower threaded portion 94 and an upper threaded portion 96. An intermediate smooth unthreaded portion 98 is disposed between the lower and upper threaded portions 94 and 96. Couplings 100 and 102 attach the short tie rod 92 to the lower tie rod 88 and to the upper tie rod 90. The use of the short tie rod 92 advantageously makes the installation of the lower tie rod 88 much simpler, since only the shorter tie rod 92 has to go through the double top plate opening 31 and the bottom plate opening 33, whereas in the embodiment shown in FIG. 6, the lower tie rod 72 has to go through the openings 31 and 33.

Note that portions of the smooth unthreaded intermediate portion 98 of the short tie rod 92 are disposed within and past the openings 31 and 33, thereby allowing relatively unhindered movement through the opening, as compared to an all-thread tie rod, when the wall shifts down due to settlement. This is advantageous when an expanding connector is used to tie the wall to the tie rods, as will be explained below.

Figure 15:
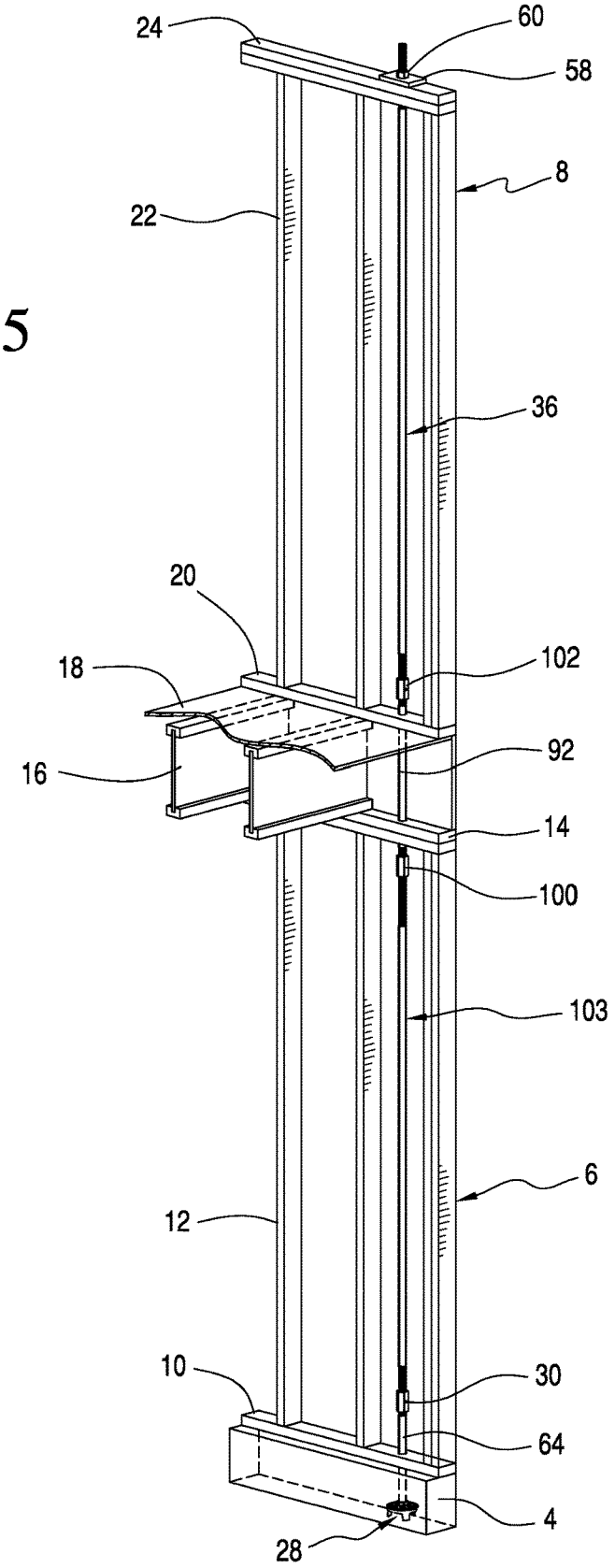
FIG. 15 is a perspective fragmentary view of a building stud wall similar to FIG. 1, showing another embodiment of the tie rod.
Figure 16:
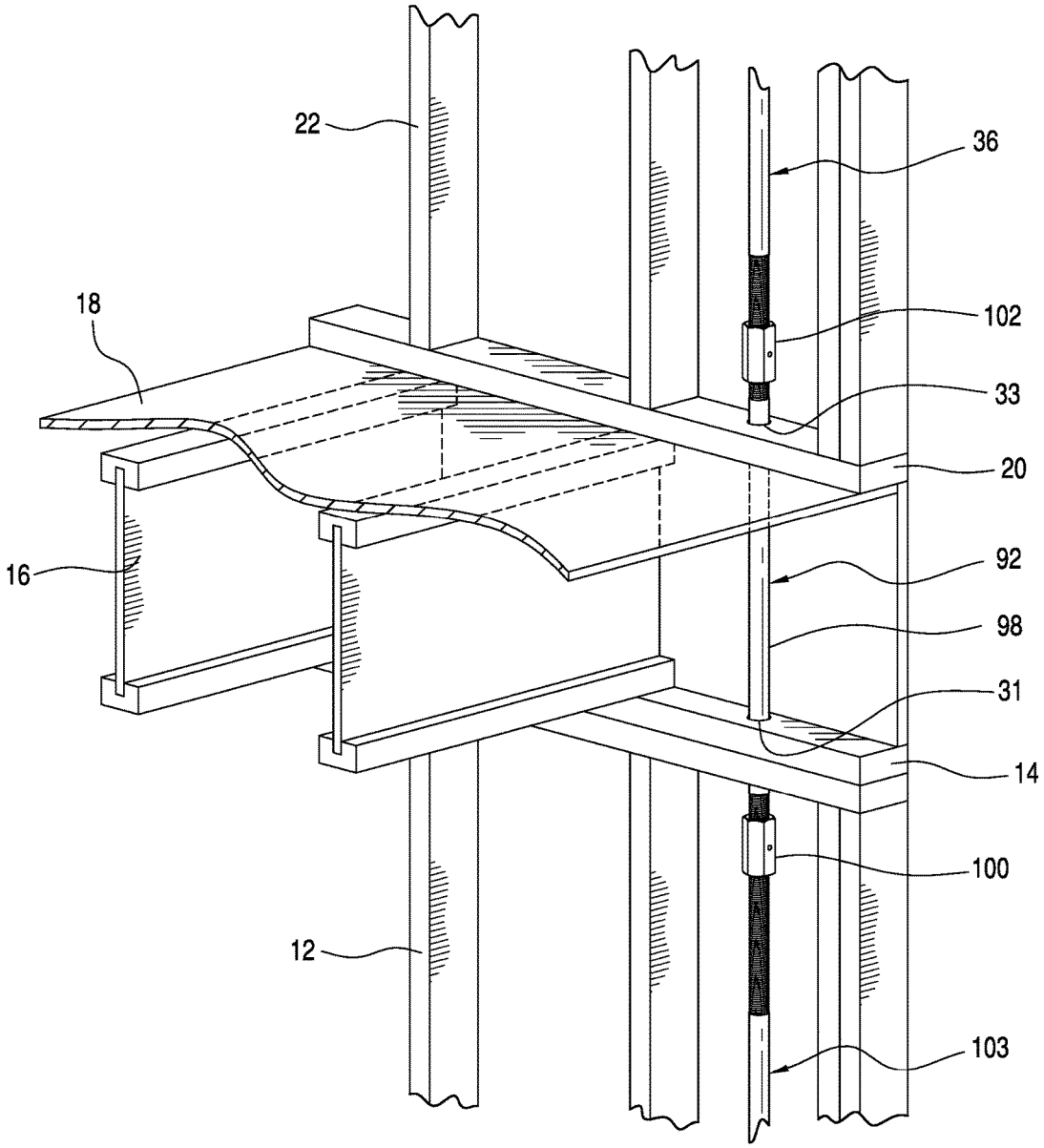
FIG. 16 is an enlarged perspective view of a portion of the tie rod through the floor joist section of the wall shown in FIG. 15, showing details of the tie rod within the floor joist section of the wall.

Referring to FIGS. 15 and 16, the same stud walls 6 and 8 are shown. A shorter tie rod 103 is shown associated with the lower stud wall 6. A short tie rod 92 is used to connect the lower tie rod 103 with the upper tie rod 36. The tie rod 92 has a lower threaded portion 94 and an upper threaded portion 96. A smooth unthreaded intermediate portion 98 is disposed between the lower and upper threaded portions 94 and 96. Couplings 100 and 102 attach the short tie rod 92 to the lower tie rod 103 and to the upper tie rod 36. The use of the short tie rod 92 advantageously makes the installation of the upper and lower tie rods much simpler, since only the short tie rod 92 has to go through the double top plate opening 31 and the bottom plate opening 33. In this embodiment, the tie rods 103 and 36 have smooth unthreaded intermediate portions to facilitate installation of other building components within the stud wall space where the tie rods are located, such as for example insulation batts, electrical wiring, water lines, waste lines, etc. The smooth unthreaded intermediate portions of the tie rods present reduced friction, as compared to all-thread tie rods, to the other building components as they are pulled and shoved past the tie rods. The smooth unthreaded intermediate portions of the tie rods also reduce bowing of the tie rods when the other building components are being installed inside the wall space occupied by the tie rods. Less bowing means that the tie rods remain vertical and aligned with the common axis of the openings 31, 33 and 62 and can, therefore, move freely through the openings during wall settlement.

Note that portions of the smooth unthreaded intermediate portion 98 of the short tie rod 92 are disposed within and past the openings 31 and 33, thereby allowing relatively unhindered movement through the openings, as compared to an all-thread tie rod, when the wall shifts down due to settlement. This is advantageous when an expanding connector is used to tie the wall to the tie rods, as will be explained below.

Figure 17:
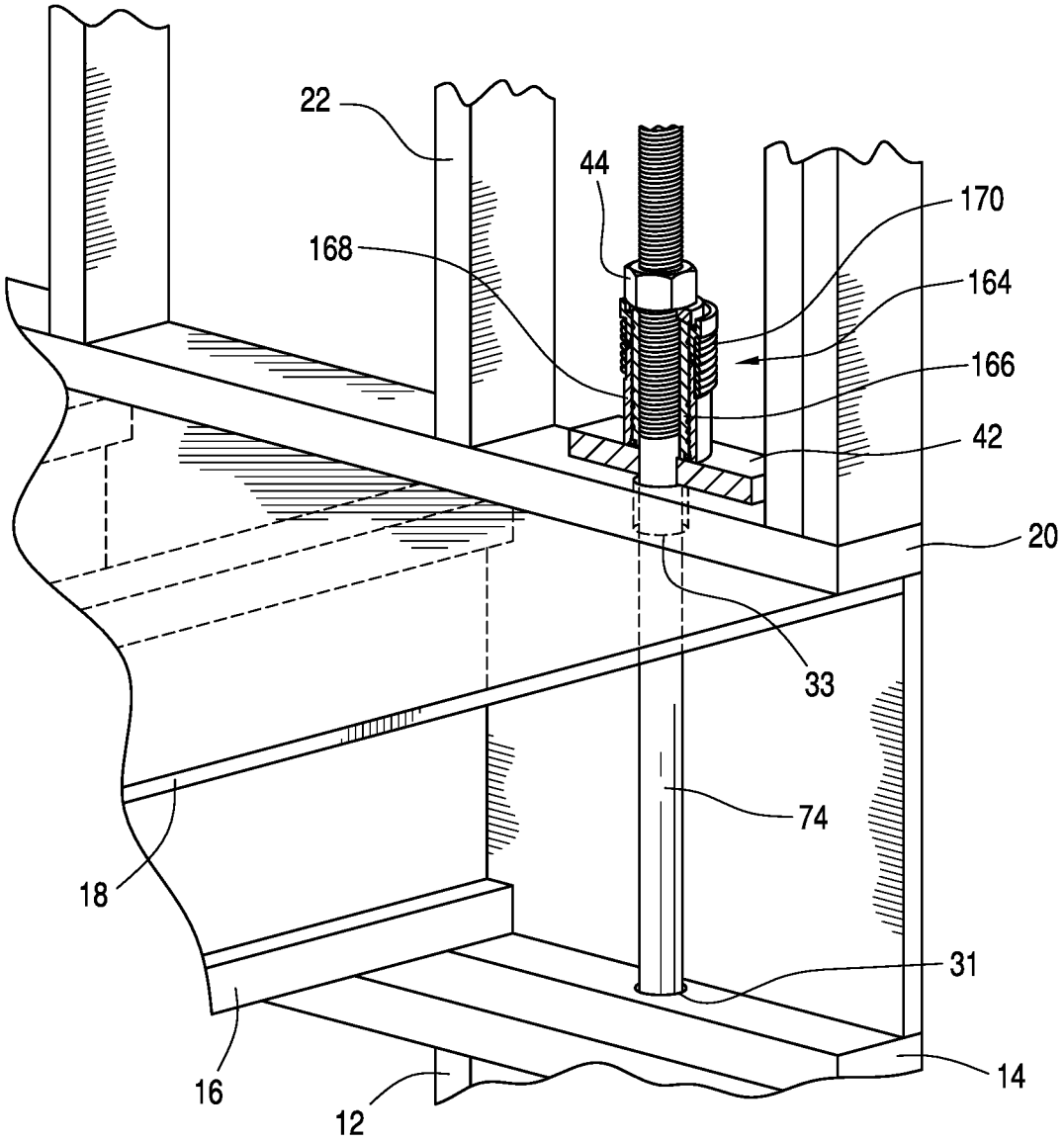
FIG. 17 is an enlarged perspective view of a portion of the tie rod through the floor joist section of the wall shown in FIG. 6, showing details of the tie rod within the floor joist section of the wall and connection to the bottom plate of the upper wall including an expanding connector for taking up slack in the tie rod.

Referring to FIG. 17, an expanding connector 164 (shown in cross-section) is disposed between the bearing plate 42 (shown in cross-section) and the nut 44. The expanding connector 164 is of standard manufacture, such as the one disclosed in U.S. Pat. Nos. 7,762,030 and 8,186,924, hereby incorporated by reference. Generally, the connector 164 has an inner cylindrical body 166 disposed within an outer cylindrical body 168. A spring 170 urges the inner cylindrical body upwardly against the nut 44 and urges the outer cylinder body 168 downwardly against the bearing plate 42. When slack develops in the tie rod below the nut 44, the spring 166 moves the inner cylindrical body 166 upwardly and locks with the outer cylindrical body 168 in the downward direction to take up the slack. During the short movement of the tie rod through the openings 31 and 33 due to wall settlement, the smooth unthreaded portion of the tie rod disposed within the openings 31 and 33 advantageously makes the movement relatively unhindered, as compared to an all-thread tie rod with threads disposed within the openings and rubbing against the wall of the opening. With an all-thread tie rod, the threads can jam against the wall of the opening when the walls settles down, causing the tie rod to bow rather than extending through the opening in the form of a slack.

Figure 18:
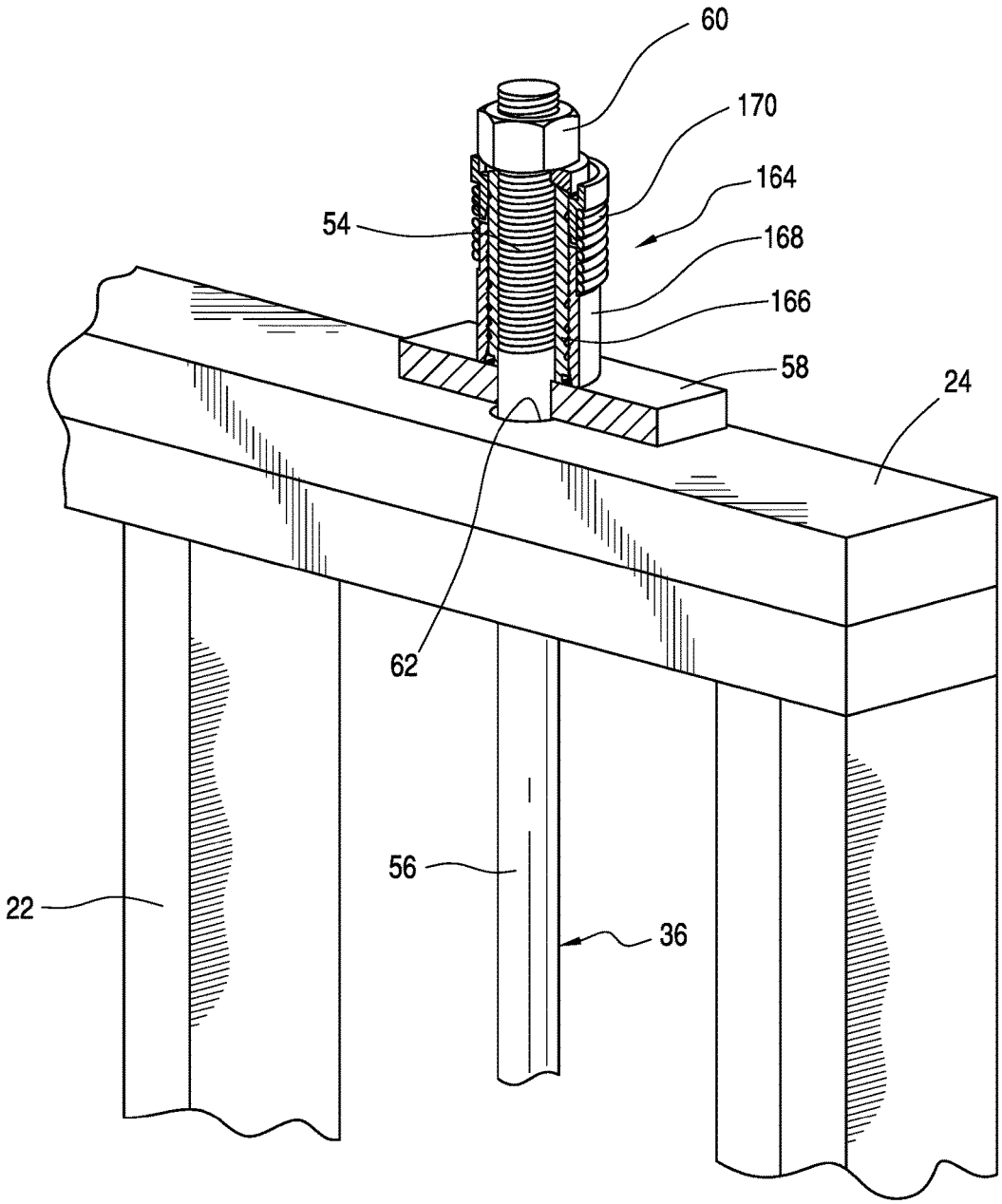
FIG. 18 is an enlarged perspective view of a section of the wall shown in FIG. 6, showing the connection of the tie rod at the top plate of the upper wall including an expanding connector for taking up slack in the tie rod.

Referring to FIG. 18, another expanding connector 164 (shown in cross-section), as described in FIG. 17, is disposed between the nut 60 and the bearing plate 58 (shown in cross-section). The expanding connector 164 is used to take up slack that may develop in the tie rod 36. Note that the smooth unthreaded portion 56 of the tie rod 36 is disposed within the opening 62 to facilitate movement of the tie rod through the opening when the wall moves down due to settlement. It should be understood that the smooth unthreaded portion of the tie rod sliding through the opening 62 is relatively easier than if threaded portions are within the opening. The opening 62 may not necessarily be vertical but could be off from the vertical, since it is made onsite with hand tools. Accordingly, having the smooth unthreaded portion of the tie rod 36 disposed within the opening 62 helps in the downward movement of the wall during settlement, thereby allowing the expanding connector 164 to take up the resulting slack. If the tie rod gets stuck within the opening during the downward movement of the wall, as when using an all-thread tie rod, the tie rod would bow within the wall space, causing a slack not to appear at the expanding connector 164.

Figure 19:
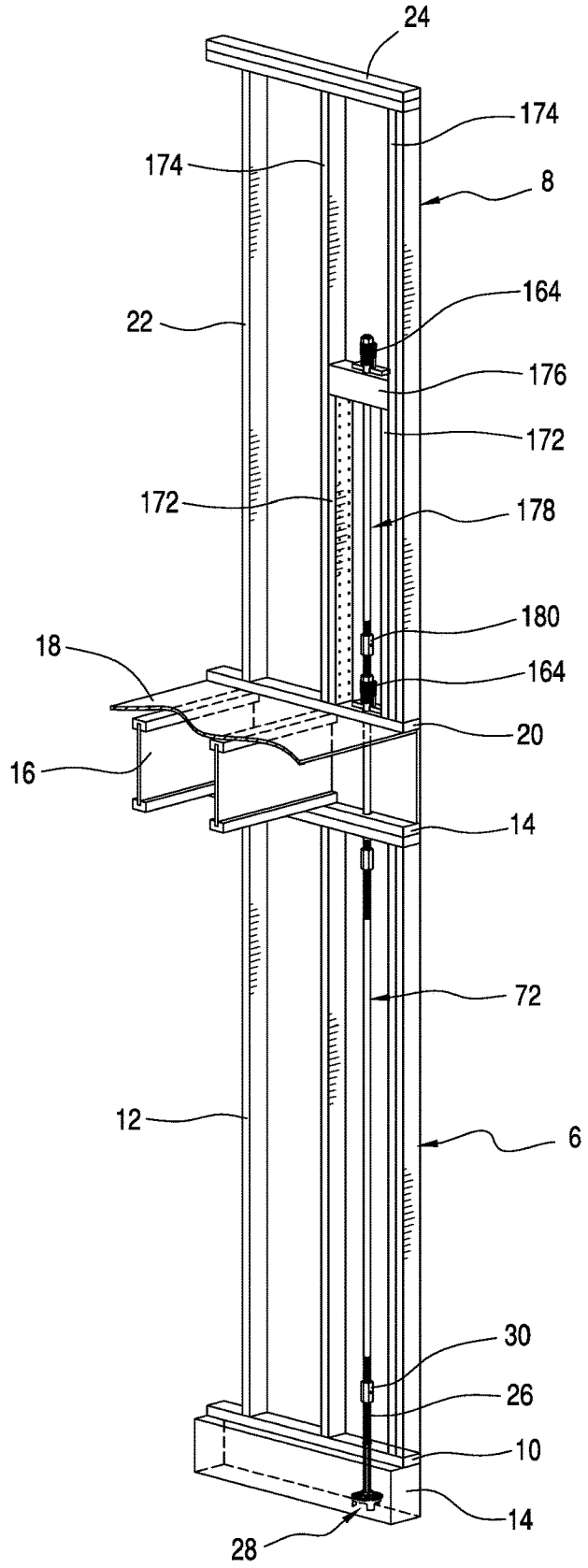
FIG. 19 is a perspective fragmentary view of a building stud wall, showing another embodiment of connecting the wall to the foundation with a tie rod and using an expanding connector for taking up slack in the tie rod.
Figure 20:
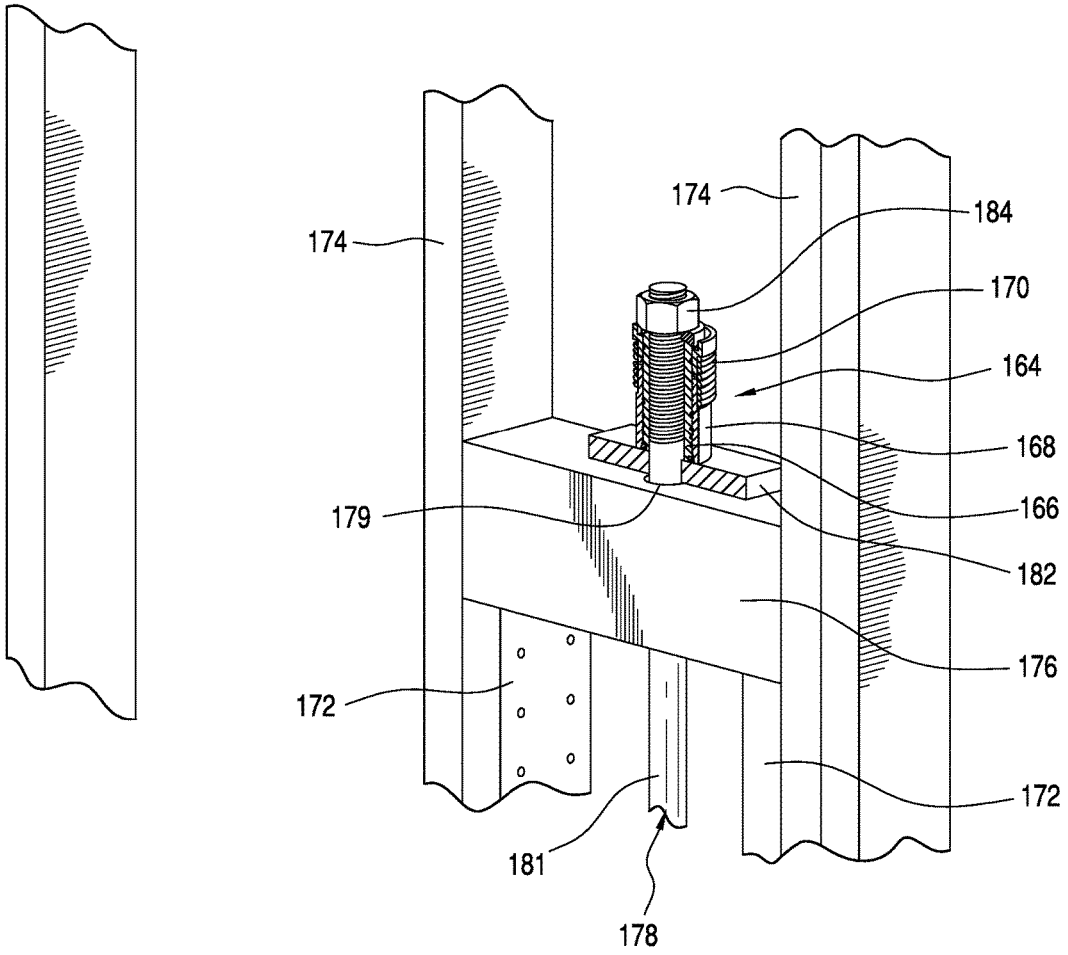
FIG. 20 is an enlarged perspective view of a section of the wall shown in FIG. 19, showing the connection of the tie rod to a cross-member at the upper wall and including an expanding connector for taking up slack in the tie rod.

Referring to FIGS. 19 and 20, the tie rod 72 extends through the double top plate 14 and the bottom plate 20. An expanding connector 164 (shown in cross-section) is disposed between the nut 44 and the bearing plate 42 (shown in cross-section), as in FIG. 17. Reinforcement studs 172 are securely attached to the respective studs 174. A cross member 176 is supported on the top edges of the respective reinforcement studs 172. A tie rod 178 is connected to the lower tie rod 72 with a coupling 180. The tie rod 178 extends through an opening 179 in the cross member 176. An expanding connector 164 connects the tie rod 178 to the stud wall 8. The connector 164 is disposed between a bearing plate 182 and a nut 184 as shown in FIG. 20. Note that a portion of the smooth unthreaded portion 181 of the tie rod 178 is disposed within the opening 179 to facilitate the downward movement of the cross-member 176 during settlement of the wall. This in turn advantageously allows the expanding connector 164 to take up the resulting slack in the tie rod 178. The diameter of the opening 179 is larger than the diameter of the intermediate portion 181, since the diameter of the threaded end portion of the tie rod is larger than the diameter of the intermediate portion (see FIG. 33).

Figure 21:
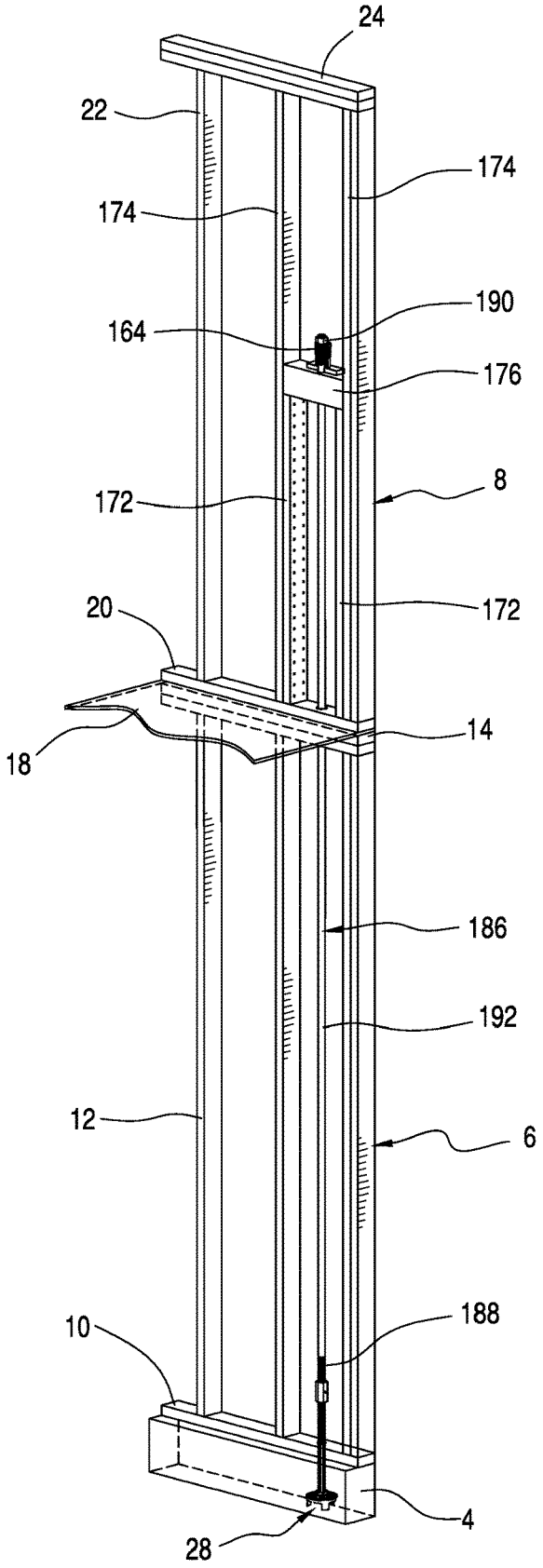
FIG. 21 is a perspective fragmentary view of a building stud wall similar to FIG. 19, showing another embodiment of the tie rod.

Referring to FIG. 21, a tie rod 186 extends from the stud wall 6 into the stud wall 8. As with all the other tie rods, the tie rod 186 has threaded end portions 188 and 190 and a smooth unthreaded intermediate portion 192 as also shown in FIG. 19. Reinforcement studs 172 are attached to respective studs 174 and a cross-member 176 is supported on the top edges of the respective reinforcement studs 172. An expanding connector 164 is disposed between a nut 184 and a bearing plate 182 (see FIG. 20).

In the embodiments shown in FIGS. 19-21, the expanding connectors 164 may be left out, leaving only the nuts 44 and 184 and the bearing plates 42 and 182, if slack on the tie rods is not a concern. Such a structure will provide a reinforced wall, although without the slack compensating function of the expanding connectors.

Figure 22:
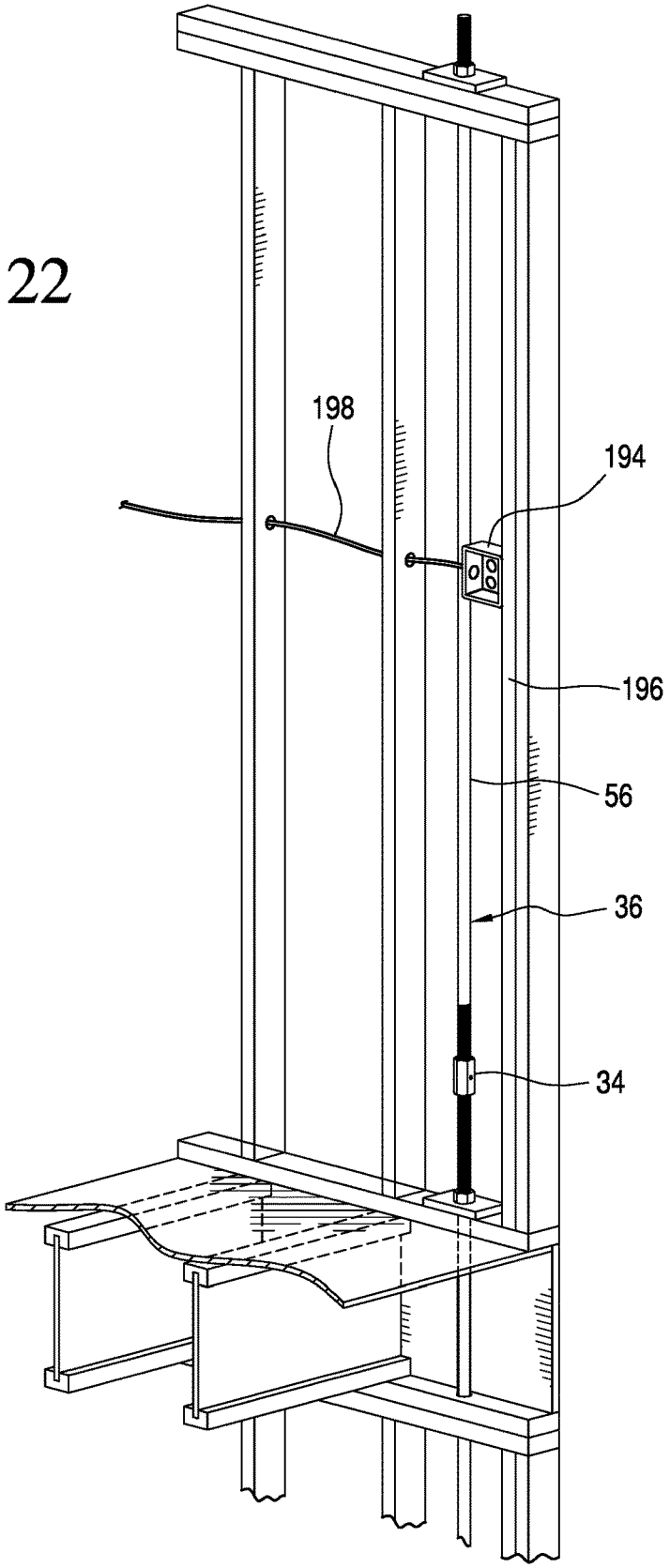
FIG. 22 is a perspective fragmentary view of a building stud wall showing an electrical box and electrical wiring strung from stud to stud.

Referring to FIG. 22, the upper stud wall 8 as shown in FIG. 6 is depicted. An electrical junction box 194 is shown attached to a stud 196. Electrical wire 198 is strung from stud to stud and terminated in the junction box 197. When the electrical wire is pulled past the tie rod 36 during installation, the wire would easily slide past the smooth unthreaded portion 56 of the tie rod. Snagging of the wire on the tie rod is reduced or avoided, thereby avoiding any bowing of the tie rod. Pulling stress on the tie rod that can cause bowing is reduced or eliminated. If an all-thread tie rod is used, the electrical wire can easily get caught in the threads and cause bowing when the wire is pulled from stud to stud. Bowing of the tie rod is to be reduced or avoided since bowing would cause the tie rod to deviate from the vertical and lose its alignment with the openings in the bottom plates and top plates, resulting in the tie rods getting jammed in the openings and slack in the tie rods will not be presented to and taken up by the expanding connectors.

Figure 23:
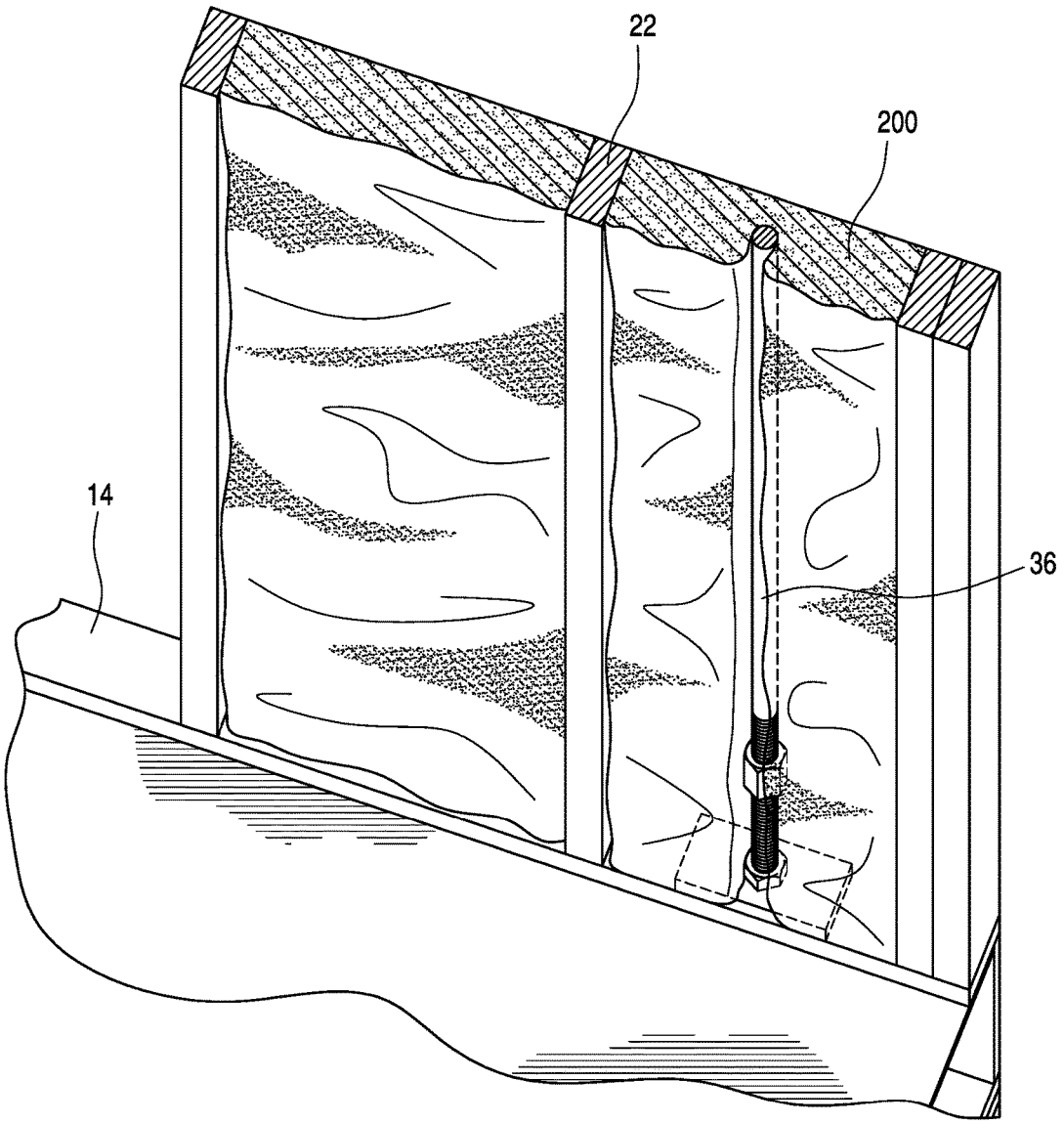
FIG. 23 is a perspective fragmentary view of a building stud wall showing a batt of insulation installed in the wall behind a tie rod.

Referring to FIG. 23, insulation batt 200 is shown installed behind the tie rod 36. The insulation batt 200 is compressed behind the tie rod 36. During installation, the insulation batt 200 is typically inserted behind the tie rod at one side and pulled to the other side. With the tie rods 32 and 36 each having at least a majority of their intermediate portions being smooth and unthreaded, installation of insulation batt is relatively made easier, since the insulation simply slides past the tie rod as the insulation batts are forced behind the tie rods at one side and pulled to at other side. If an all-thread tie rod were used, the insulation batt could get caught in the threads, thereby causing the insulation batts to bunch behind the tie rod and cause the tie rod to bow out, which is undesirable. Further, if the tie rod bows during installation, it will spring back to its original straight position, since the smooth unthreaded intermediate portion of the tie rod will simply slide past the insulation batt. On the other hand, if an all-thread tie rod had been used, the threads will be jammed against the insulation back which would prevent the tie rod from straightening up.

Figure 24:
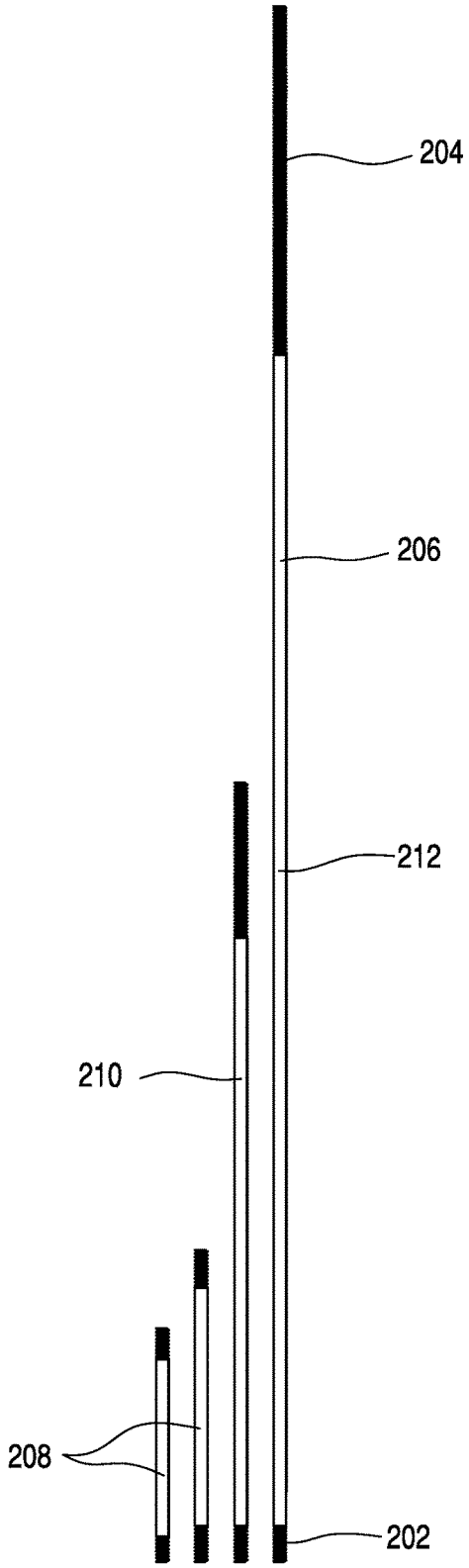
FIG. 24 is front elevational view of a number of tie rods used in the present invention, shown in various relative lengths.

Referring to FIG. 24, a number of tie rods of varying lengths are disclosed for use in the present invention. Each tie rod has threaded end portions 202 and 204 and smooth unthreaded intermediate portion 206. The ratio of the smooth unthread intermediate portion 206 is preferably about 75% or more of the length of the tie rod. The combined length of the threaded end portions 202 and 204 is about 25% or less of the length of the tie rod. The short tie rods 208 may be used as anchor rods as shown in FIG. 5, for example, or to extend across the height of the floor joists, as shown in FIG. 14, for example. The intermediate length tie rod 201 may be used within a wall without extending into the upper wall, such as for example within the lower stud wall 6 or the upper stud wall 8, as shown in FIG. 15. The longer tie rod 212 may be used to extend from a lower wall to an upper wall as shown in FIG. 1, for example.

Figure 25:
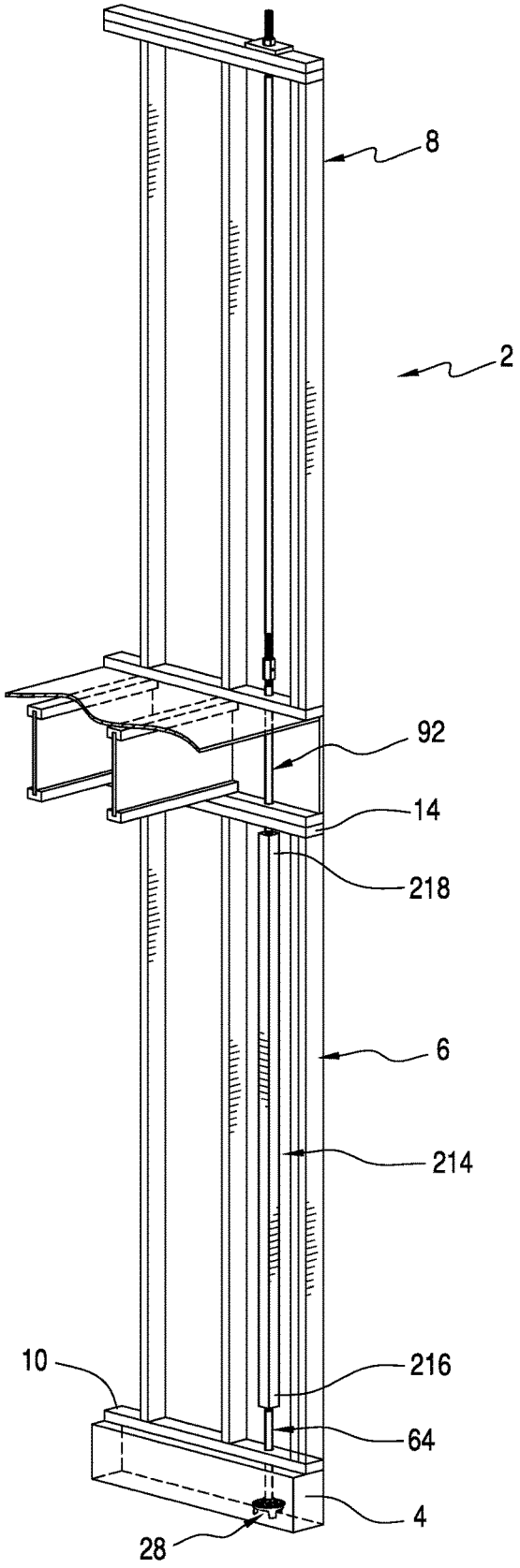
FIG. 25 is a perspective fragmentary view of a building stud wall similar to FIG. 1, showing another embodiment of the tie rod.
Figure 26:
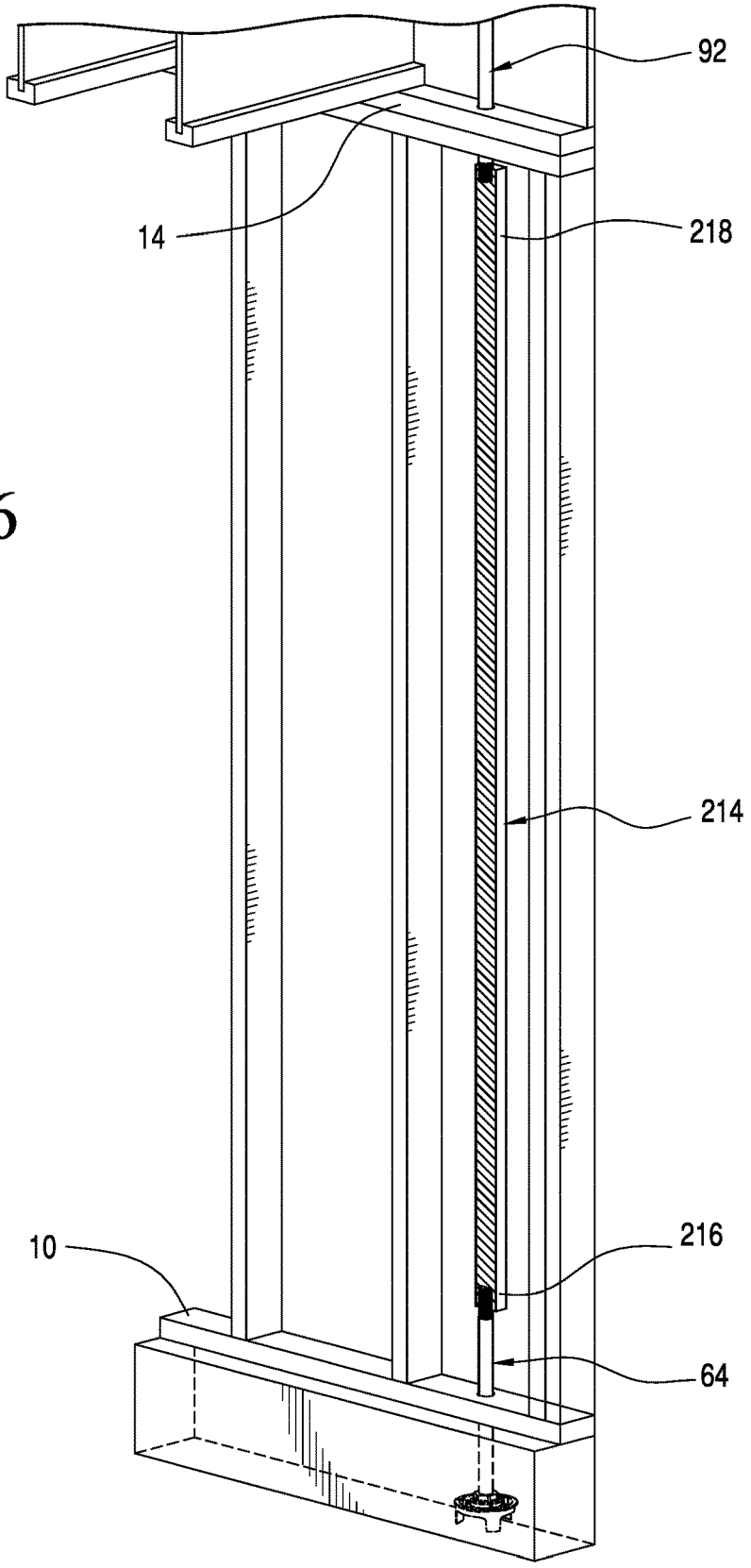
FIG. 26 is an enlarged perspective view of a portion of the wall shown in FIG. 25, showing the tie rod in cross-section.

Referring to FIGS. 25 and 26, the building wall 2 is disclosed with a different embodiment of a tie rod 214 with lower threaded bore 216 and upper threaded bore 218. The lower threaded bore 216 is screwed to the anchor rod 64 while the upper threaded bore 218 is screwed to the short tie rod 92. The anchor rod 26 may also be used. The exterior surface of the tie rod 214 is smooth and unthreaded and is substantially co-extensive with the length of the tie rod.

The tie rod 214 is in effect a long coupling. The threaded bores 216 and 218 are preferably limited to about 25% or less of the length of the tie rod 214. Since the threaded bores are sized to receive a standard tie rod, the diameter or cross-sectional area of the tie rod 214 will be larger than the diameter of the standard all-thread tie rod. Accordingly, the tension stress along the tie rod 214 will be advantageously decreased and will experience less stretch at load. Further, the stiffness of the assembly of tie rods shown in FIG. 25 will be advantageously greater than the assembly using outside threaded rods exclusively, as shown in FIG. 1, for example, since the tie rod 214 has a larger diameter than the other tie rod. Greater stiffness advantageously provides for less bowing.

Figure 27:
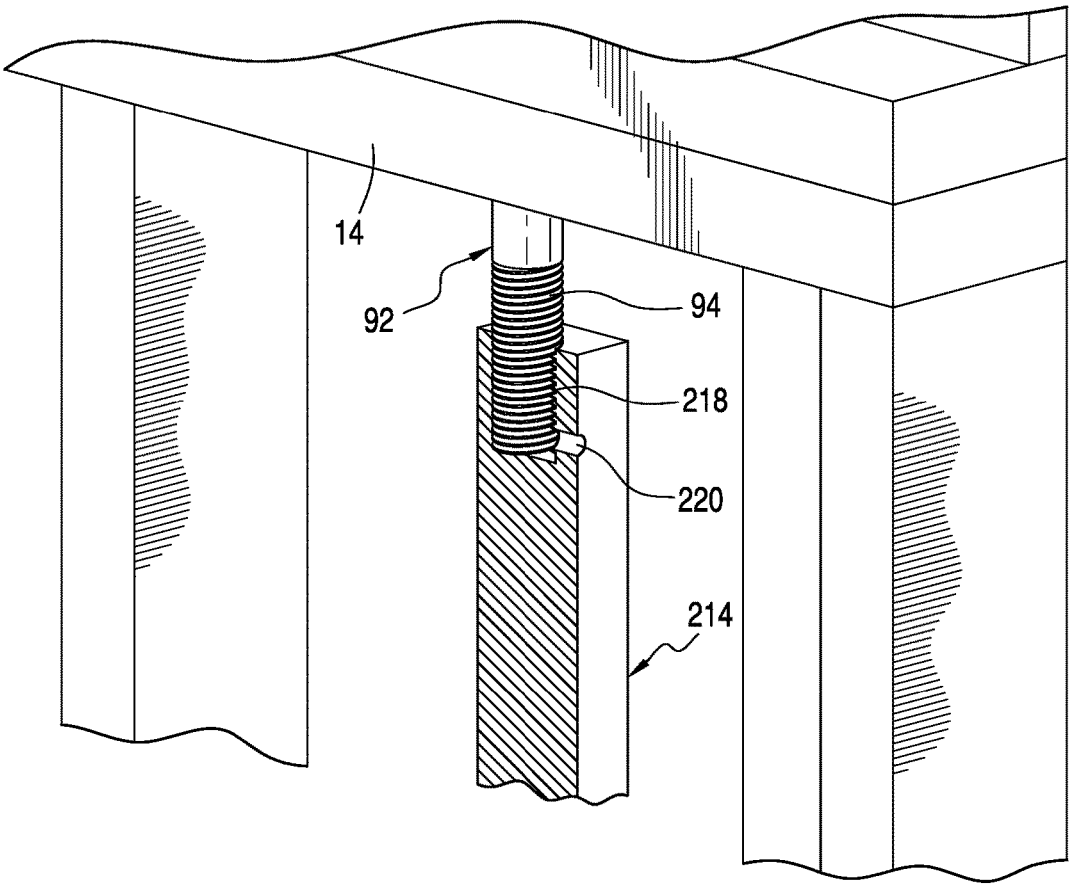
FIG. 27 is an enlarged perspective and cross-sectional view of a portion of the tie rod shown in FIG. 25, showing another embodiment of the tie rod in cross-section.
Figure 28:
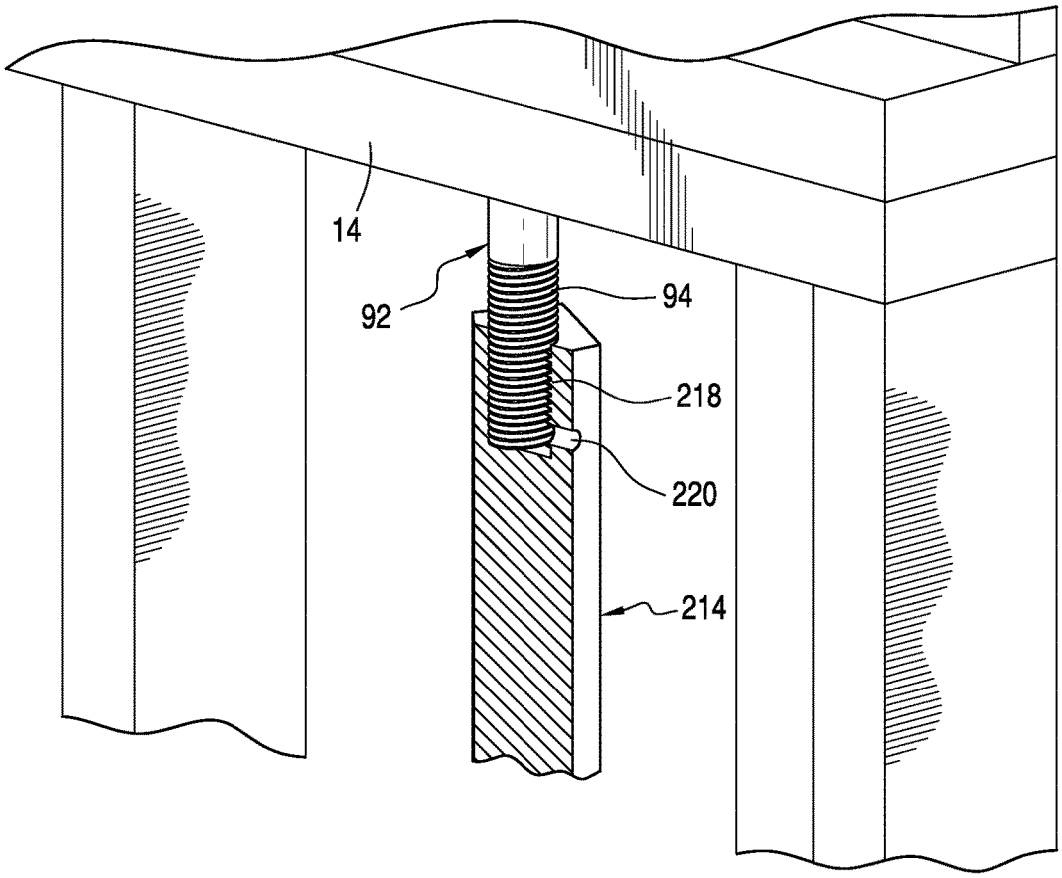
FIG. 28 is an enlarged perspective and cross-sectional view of a portion of the tie rod shown in FIG. 25, showing yet another embodiment of the tie rod in cross-section.
Figure 29:
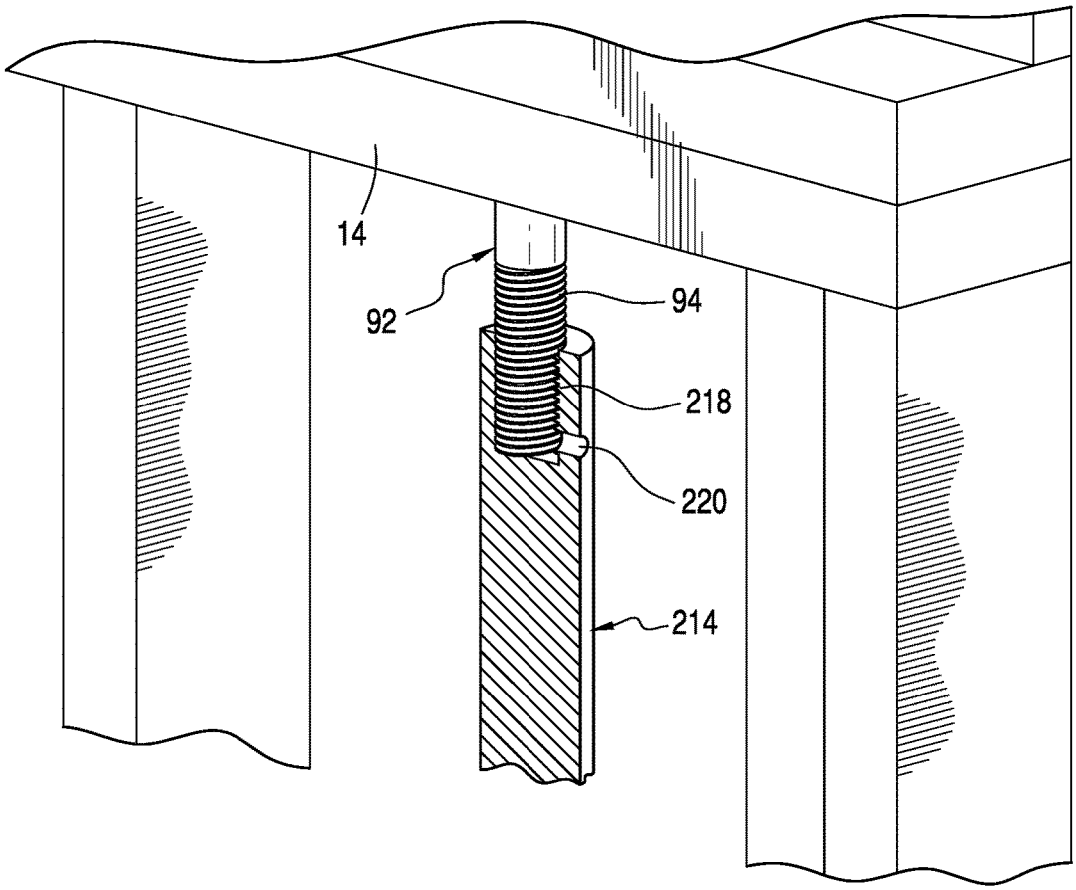
FIG. 29 is an enlarged perspective and cross-sectional view of a portion of the tie rod shown in FIG. 25, showing still another embodiment of the tie rod in cross-section.

Referring to FIGS. 27, 28 and 29, the tie rod 214 may be square in cross-section, as shown in FIG. 27, hexagonal as shown in FIG. 28 or circular, as shown in FIG. 29. The lower threaded bore 216 and the upper threaded bore 216 each includes a radial inspection hole 220 to allow physical checking that the threaded portion 94 is at or past the hole 220, thus insuring that the threaded portion 94 is deep enough into the threaded bores 218 and 216 for proper load capacity.

It should be understood that the tie rod 214 with the appropriate length may extend through the top plate 14 and the bottom plate 20, similar to the tie rod 36 shown in FIG. 1, or the tie rod 192 shown in FIG. 21 and then operably attached to the stud wall 8 with a tie rod such as the tie rod 36 with the appropriate length and secured to the top plate 24 or the cross member 176 with a nut and bearing plate, as disclosed herein with the other tie rods.

Figure 30:
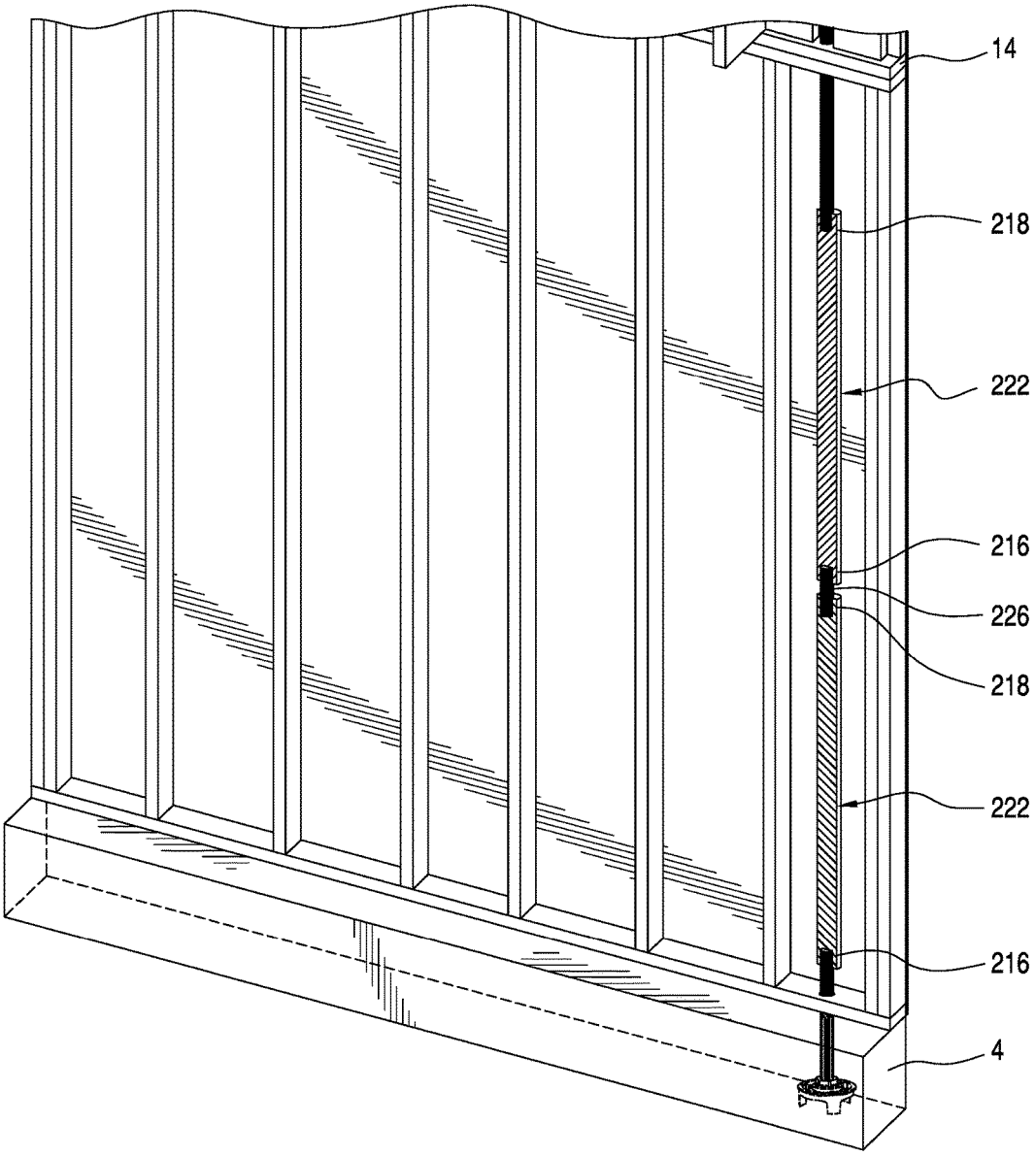
FIG. 30 is a perspective fragmentary view of a building stud wall similar to FIG. 25, showing another embodiment of the tie rod in cross-section.

Referring to FIG. 30, the tie rod 214 shown in FIG. 25 may be made in two or more sections 222. Each section 222 has the lower and upper threaded bores 216 and 218. A threaded rod 226 connects the two sections 222 together. The tie rods 222 advantageously make the whole assembly stiffer due to the larger cross-sectional area of the tie rods 22. The threaded bores 216 and 218 are preferably limited to about 25% or less of the length of the tie rods 222.

Figure 31:
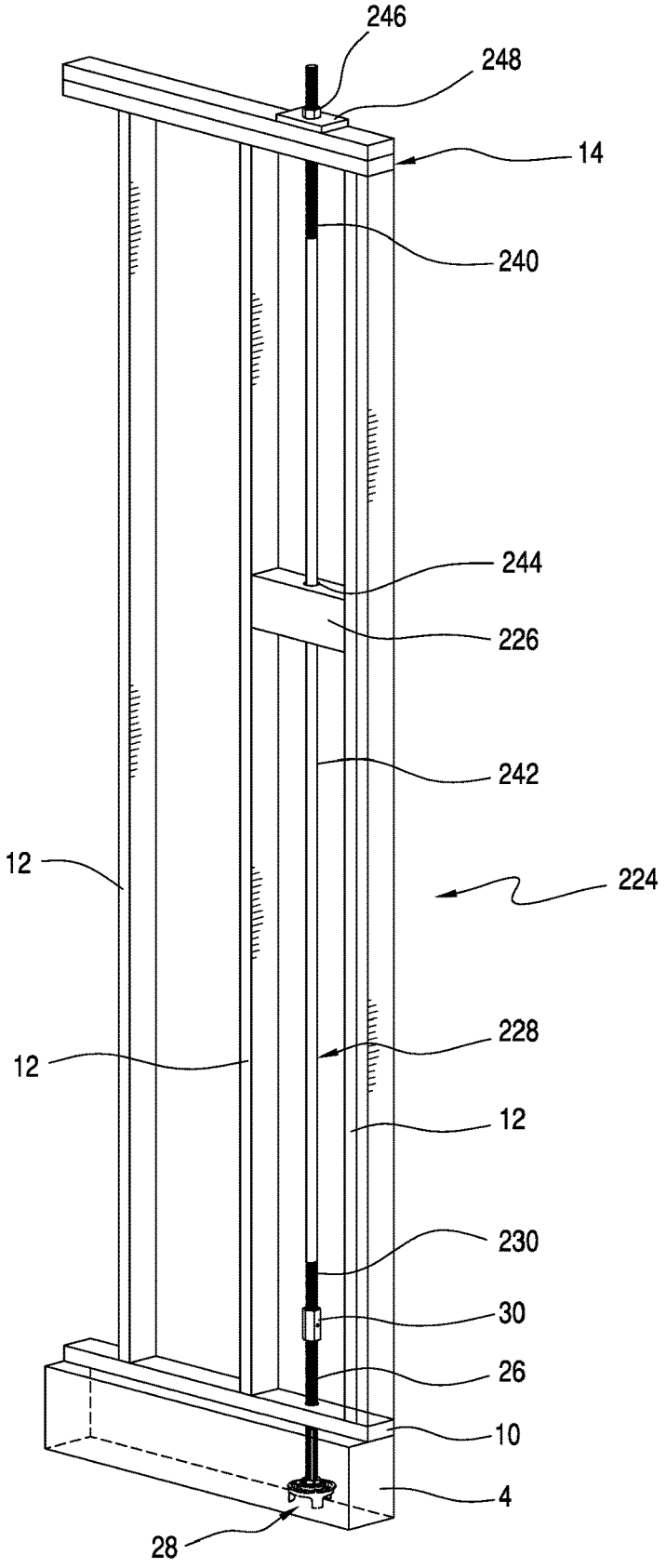
FIGS. 31 and 32 show a perspective fragmentary view of a one-story building stud wall, showing a tie rod connected to the wall and the foundation.

Referring to FIG. 31, a one-story stud wall 224 is shown. Similar to FIG. 1, the wall 224 is supported by the foundation the foundation 4. The wall 224 has studs 12, bottom plate 10 and double top plate 14. A blocking 226 is attached between studs to provide additional rigidity and nailing surface to the wall 224.

The anchor rod 26 is attached to the anchor assembly 28, which is operably attached to the foundation 4, such as being embedded within the foundation 4 made of poured concrete. The anchor rod 26 extends outside the foundation 4 and through the base plate 10. The coupling 30 connects the anchor rod 26 to a tie rod 228, which extends through the top plate 14. The lower end portion 230 and the upper end portion 240 of the tie rod 228 are threaded while the rest or intermediate portion 242 of the tie rod is smooth and unthreaded.

The intermediate portion 242 extends through an opening 244 in the blocking 226. The opening 244 is larger than the diameter of the intermediate portion 242 to advantageously permit the tie rod 228 easily move through the opening during installation. A nut 246 screwed to the upper end portion 240 of the tie rod and tightened against a bearing plate 248 secures the tie rod 228 to the wall 224, thereby holding the wall 224 to the foundation 4. An expanding connector 164, as shown in FIG. 17, may be installed between the nut 246 and the bearing plate 248 to take up any slack that may develop in the tie rod 228 due to wall shrinkage, settlement, etc. The opening 244, which is larger than the diameter of the intermediate portion 242, provides space and less friction for the tie rod when it moves through the opening 244 during vertical movement of the wall 224.

Figure 32:
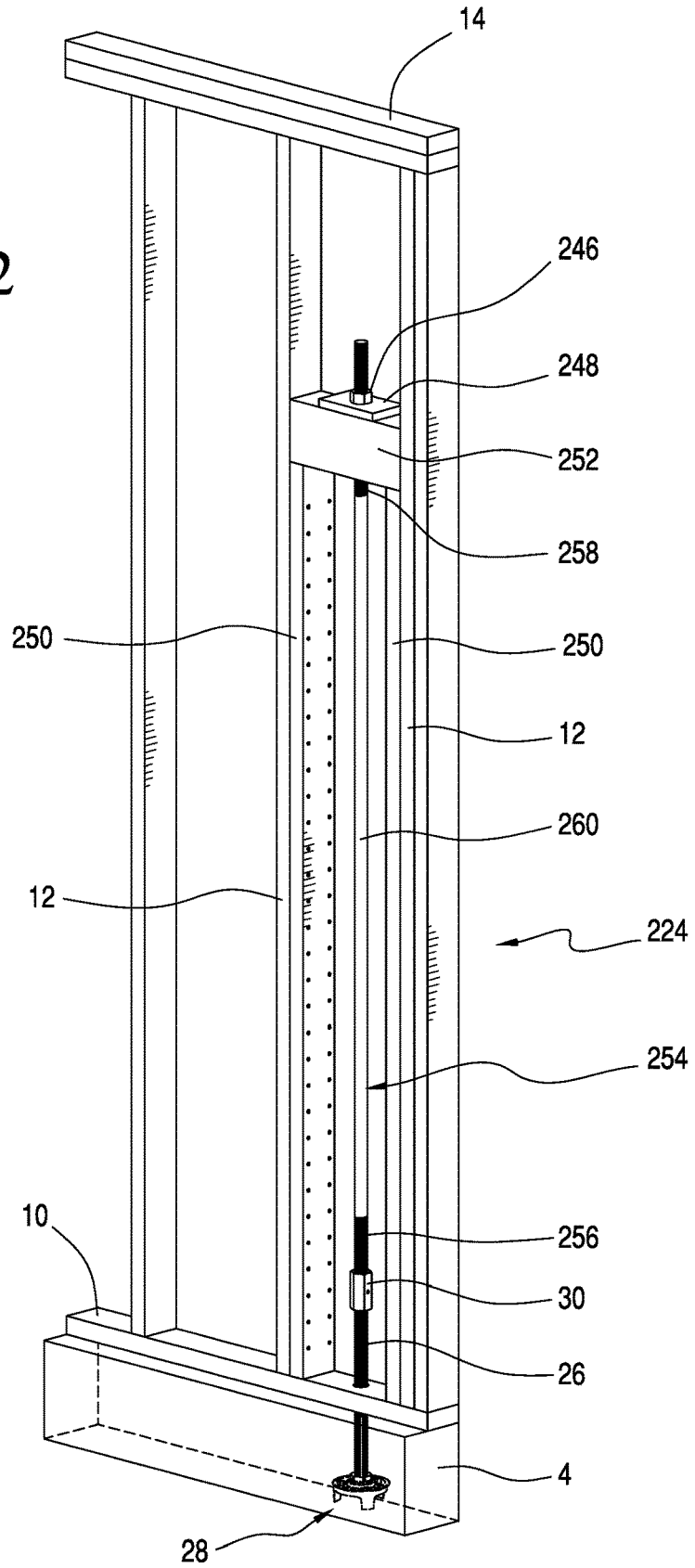

Referring to FIG. 32, the wall 224 is shown with reinforcement studs 250 and a cross member 252. The reinforcement studs are securely attached to the respective studs 12 with nails, screws or other standard hardware. A shorter tie rod 254 having threaded end portions 256 and 258 and smooth unthreaded intermediate portion 260 is used. The lower end portion 256 is attached to the anchor rod 26 with the coupling 30. The upper end portion 258 extends through an opening in the cross member 252 and attached thereto with the nut 246 and the bearing plate 248. The cross member is supported on the top edges of the reinforcement studs 250.

An expanding connector 164, as shown in FIG. 17, may be installed in FIG. 32 between the nut 246 and the bearing plate 248 to take up any slack that may develop in the tie rod 254 due to wall shrinkage, settlement, etc.

Figure 33:
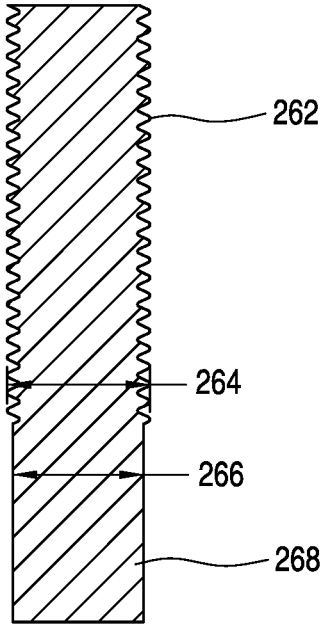
FIG. 33 is an enlarged cross-sectional view of a threaded end portion of a tie rod used in the present invention.

Referring to FIG. 33, each of the tie rods used in the present invention is made by rolling the threads 262 at each end of a smooth rod. This results in making the diameter 264 of the threaded end portions larger than the diameter 266 of the smooth unthreaded intermediate portion 268. The threaded end portion is about 10% larger in diameter than the diameter of the intermediate portion 264. The larger diameter threaded end portions means that openings drilled in the bottom plates and top plates of the stud walls when installing the tie rods will be sized to the larger diameter threaded end portions instead of the smaller diameter intermediate portion, thereby providing a larger opening through with which the intermediate portion will slide during vertical movement of the wall during settlement, shrinkage, etc. A larger opening advantageously provides less friction for the intermediate portion of the tie rods.

Figure 34:
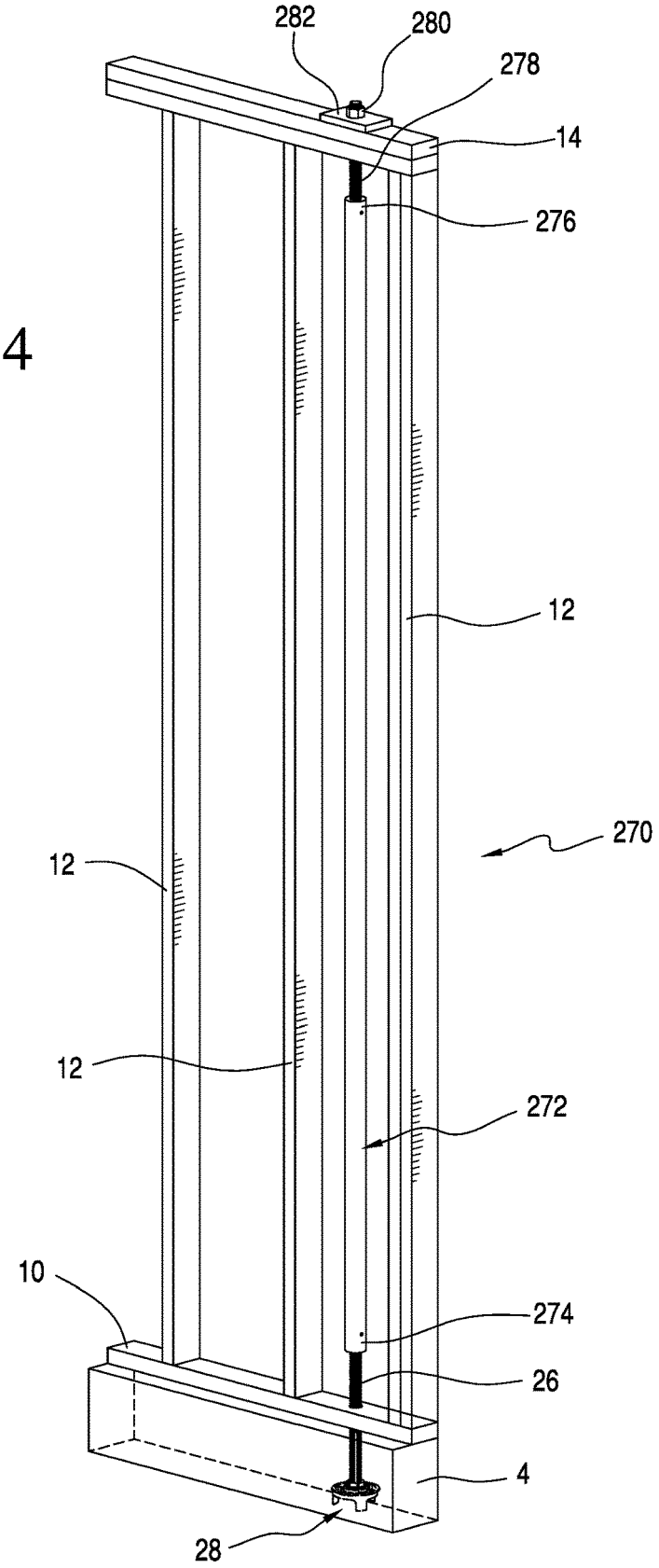
FIG. 34 shows a perspective fragmentary view of a one-story building stud wall similar to FIG. 31, showing another embodiment of the tie rod.

Referring to FIG. 34, a one-story stud wall 270 is shown. Similar to FIG. 1, the wall 270 is supported by the foundation the foundation 4. The wall 270 has studs 12, bottom plate 10 and double top plate 14. The anchor rod 26 is attached to the anchor assembly 28, which is operably attached to the foundation 4, such as being embedded within the foundation 4 made of poured concrete. The anchor rod 26 extends outside the foundation 4 and through the base plate 10. A tie rod 272 with lower threaded bore 274 and upper threaded bore 276. The lower threaded bore 274 is screwed to the anchor rod 26 while the upper threaded bore 276 is screwed to a short threaded rod 278. The exterior surface of the tie rod 272 is smooth and unthreaded and is substantially co-extensive with the length of the tie rod.

A nut 280 screwed to the upper end portion of the threaded rod 278 and tightened against a bearing plate 282 secures the tie rod 272 to the wall 270, thereby holding the wall 270 to the foundation 4. An expanding connector 164, as shown in FIG. 17, may be installed between the nut 280 and the bearing plate 282 to take up any slack that may develop in the tie rod 272 due to wall shrinkage, settlement, etc.

The tie rod 272 may be square in cross-section as shown in FIG. 27, hexagonal as in shown in FIG. 28, or circular as shown in FIG. 29.

Figure 35:
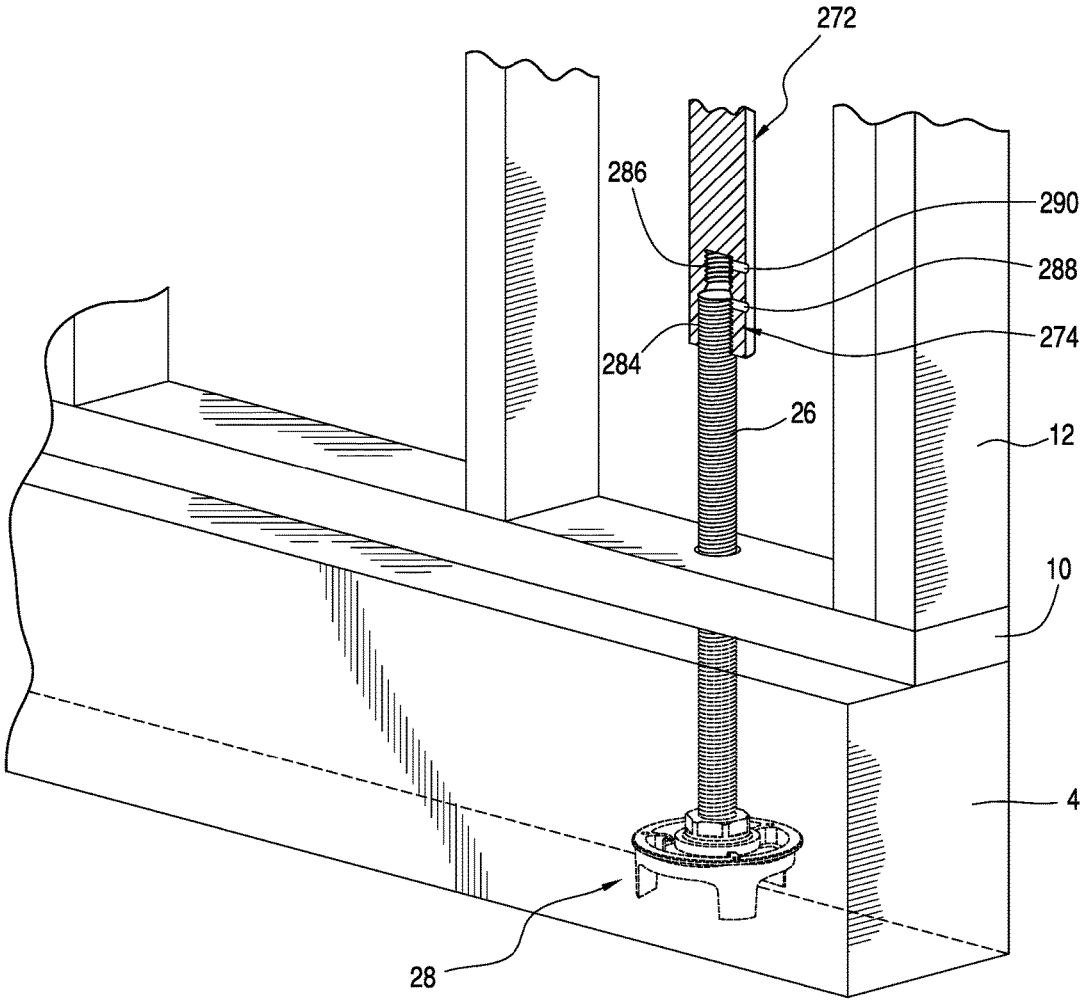
FIGS. 35 and 36 are enlarged perspective views of a section of the wall shown in FIG. 34, showing the tie rod in cross-section to reveal multiple diameter threaded bores.
Figure 36:
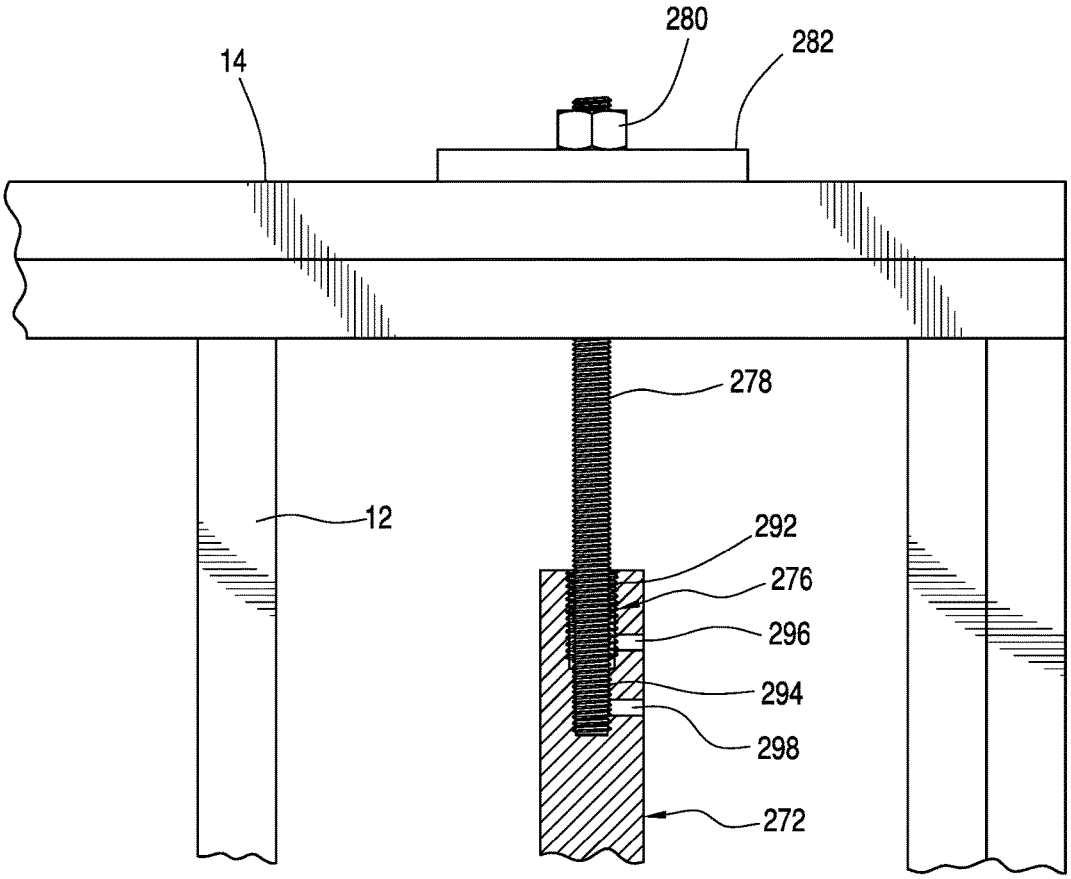

The threaded bores 274 and 276 may be of one diameter, as shown in FIG. 27, for example, or multiple diameters, as shown in FIGS. 35 and 36.

Referring to FIG. 35, with the tie rod 272 shown in cross-section, the threaded bore 274 includes a larger diameter threaded bore 284 and a smaller diameter threaded bore 286. A larger diameter anchor rod 26 is shown screwed to the larger diameter threaded bore 284. Inspection openings 288 and 290 are associated with respective threaded bores 284 and 286.

Referring to FIG. 36, with the tie rod 272 shown in cross-section, the threaded bore 276 includes a larger diameter threaded bore 292 and a smaller diameter threaded bore 294. A smaller diameter rod 278 is shown screwed to the smaller diameter threaded bore 294. Inspection openings 296 and 298 are associated with the respective threaded bores 292 and 294.

Figure 37:
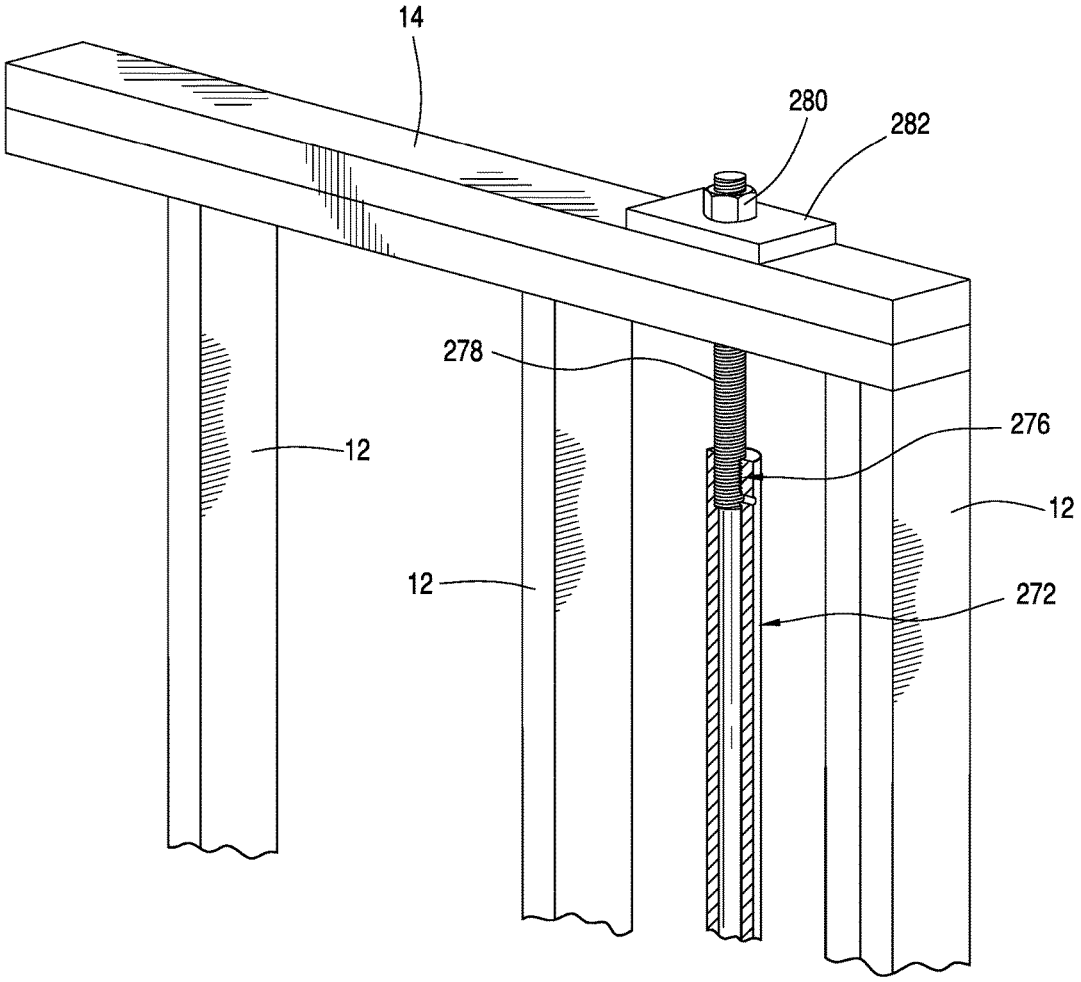
FIG. 37 is an enlarged perspective view of a section of the wall shown in FIG. 34, showing a tubular embodiment of the tie rod in cross-section.
Figure 38:
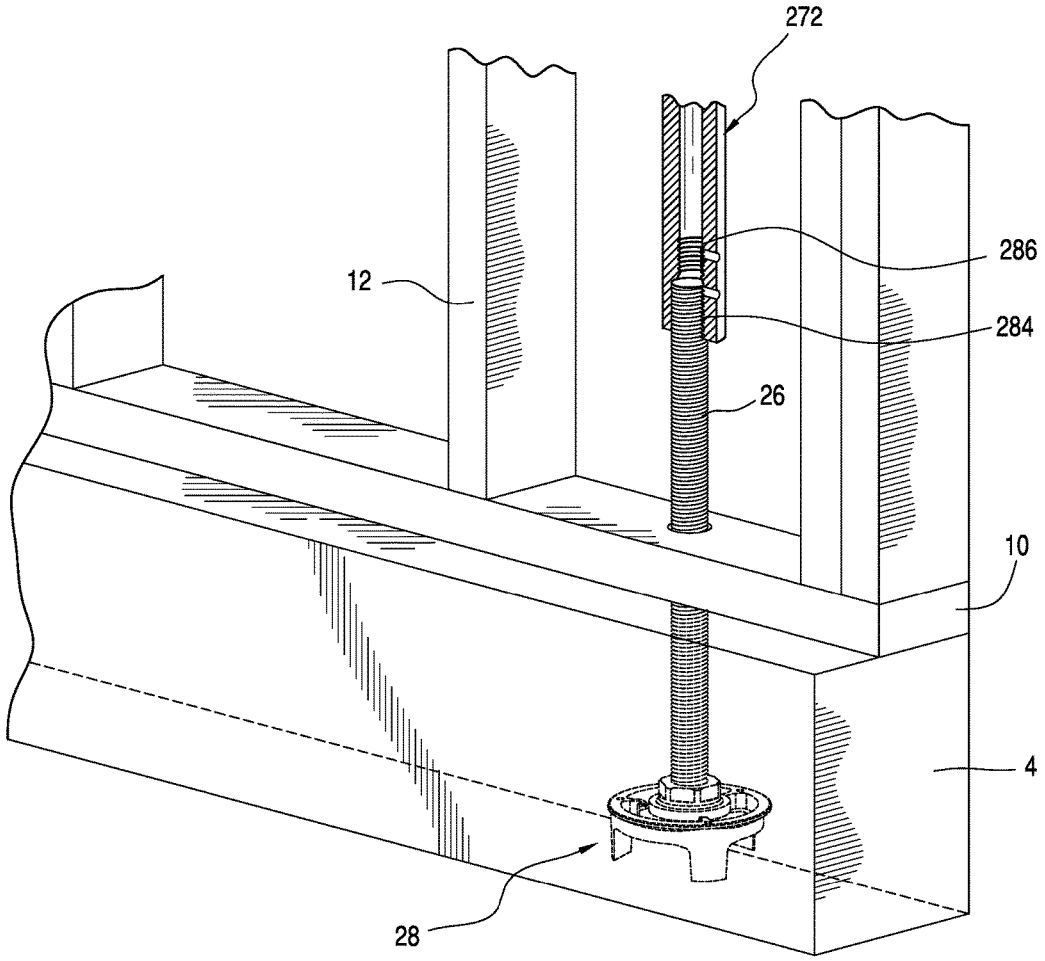
FIGS. 38 and 39 are enlarged perspective views of a section of the wall shown in FIG. 34, showing the tubular tie rod with multiple diameter threaded bores in cross-section.
Figure 39:
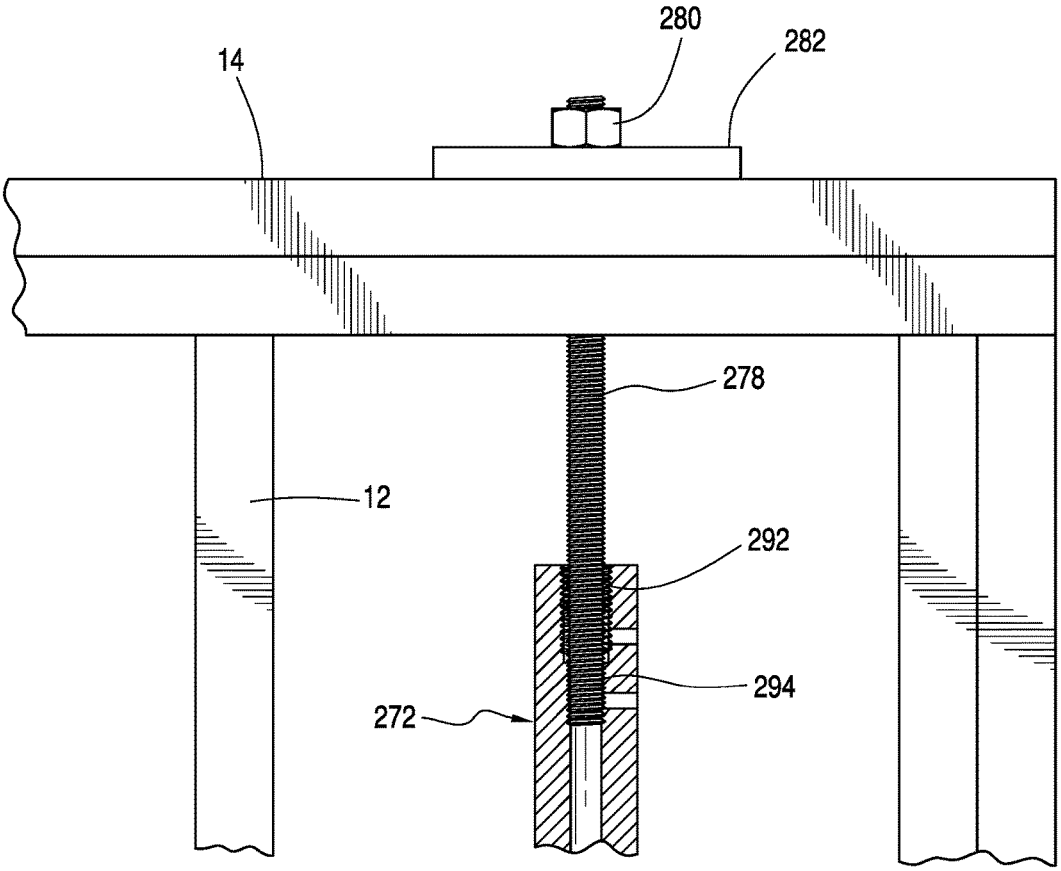

The tie rod 272 may be tubular with single diameter threaded bores 274 and 276, as shown in FIG. 37 (the tie rod 272 shown in cross-section) or multiple diameter threaded bores 284 and 286 as shown in FIG. 38 (the tie rod 272 shown in cross-section) and multiple diameter threaded bores 292 and 294 as shown in FIG. 39 (the tie rod 272 shown in cross-section). It should be understood that the tubular embodiment of the tie rod 272 may be square, hexagonal or circular in cross-section. The tubular embodiment of the tie rod 272 may also be used in a two-story wall, as shown in FIG. 25.

Providing multiple diameter threaded bores advantageously allows the use of larger or smaller diameter threaded rod for different load loads.

The various reinforced walls disclosed above are shown with tie rods installed within the first stud bay from the end of a shear wall using standard wood framing construction. However, the reinforced walls are not limited to these locations or type of construction. Metal studs or other materials may also be used. The reinforced walls may be used in any stud wall construction to resist uplift caused by high winds or earthquake conditions. The tie rods used in the reinforced walls may be installed in the first stud bay at the first bay after a window or door opening. Generally, the reinforced walls may be used as the application dictates.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A reinforced building wall, comprising:

a) a first stud wall including a bottom plate and a top plate;

b) a first threaded rod extending through the bottom plate, the first threaded rod having a first end operably anchored to a foundation and a second end;

c) a first tie rod having a first end with a first threaded bore and a second end with a second threaded bore, the first tie rod being one piece including a solid first portion extending between the first threaded bore and the second threaded bore, the solid first portion having a length longer than a length of the first threaded bore or the second threaded bore, the solid first portion having a cross-sectional size equal to a cross-sectional size of the first end and the second end, the first threaded bore is threaded to the second end of the first threaded rod;

d) a second tie rod having a third end with a third threaded bore and fourth end with a fourth threaded bore, the second tie rod being one piece including a solid second portion extending between the third threaded bore and the fourth threaded bore, the solid second portion having a length longer than a length of the third threaded bore or the fourth threaded bore, the solid second portion having a cross-sectional size equal to a cross-sectional size of the third end and fourth end;

e) a second threaded rod threaded to the second threaded bore and the third threaded bore to attach the first tie rod to the second tie rod; and f) a third threaded rod threaded to the fourth threaded bore, the third threaded rod extending through the top plate.

2. A reinforced building wall as in claim 1, wherein inspection openings are associated with one of the first, second, third and fourth threaded bores.

3. A reinforced building wall as in claim 1, wherein one of the first, second, third and fourth threaded bores are multi-diameter bores.

4. A reinforced building wall as in claim 1, wherein an intermediate portion of the first and second tie rods has a larger diameter than the diameter of the first, second, third and fourth bores.

5. A reinforced building wall as in claim 1, wherein the first and second threaded bores together constitute about 25% or less of the length of the first tie rod.

6. A reinforced building wall as in claim 1, wherein the third and fourth threaded bores together constitute about 25% or less of the length of the second tie rod.

7. A reinforced building wall as in claim 1, wherein the first and second tie rods are hexagonal, circular or square in cross-section.

8. A reinforced building wall as in claim 1, wherein the third threaded rod is operably attached to the top plate.

9. A reinforced building wall as in claim 1, and further comprising:

a) a second stud wall disposed above the first stud wall; and b) the third threaded rod is operably attached to the second stud wall.

10. A reinforced building wall as in claim 8, and further comprising:

a) a bearing plate disposed on the top plate;

b) the third threaded rod extends through the bearing plate; and c) the third threaded rod is attached to the bearing plate with a nut.

11. A reinforced building wall as in claim 9, and further comprising:

a) a bearing plate disposed on a top plate of the second stud wall;

b) the third threaded rod extends through the top plate of the second stud wall and the bearing plate; and c) the third threaded rod is attached to the bearing plate with a nut.

12. A reinforced building wall as in claim 9, and further comprising:

a) a cross member operably attached to the second stud wall;

b) a bearing plate disposed on the cross member;

c) the third threaded rod extends through the cross member and the bearing plate; and d) the third threaded rod is attached to the bearing plate with a nut.

13. A reinforced building wall as in claim 1, wherein:

a) the third threaded rod includes a distal threaded end portion and an unthreaded intermediate portion; and b) the distal threaded end portion is not disposed with the top plate.

14. A reinforced building wall as in claim 12, wherein:

a) the third threaded rod includes a distal threaded end portion and an unthreaded intermediate portion; and b) the distal threaded end portion is not disposed with the cross member.

15. A reinforced building wall as in claim 9, and further comprising:

a) a bearing plate disposed on a bottom plate of the second stud wall;

b) the third threaded rod extends through the bottom plate of the second stud wall and the bearing plate; and c) the third threaded rod is attached to the bearing plate with a nut.

16. A reinforced building wall as in claim 15, wherein:

a) the third threaded rod includes a distal threaded end portion and an unthreaded intermediate portion; and b) the distal threaded end portion is not disposed with the top plate of the first stud wall and the bottom plate of the second stud wall.

* * * * *